US011019443B2

(12) United States Patent
Yoshioka et al.

(10) Patent No.: US 11,019,443 B2
(45) Date of Patent: May 25, 2021

(54) SPEAKER DIAPHRAGM INCLUDING CONE FORMED OF MATERIAL INCLUDING FIBERS DERIVED FROM PLANT AND RESIN, SPEAKER UNIT, SPEAKER, AND METHOD FOR MANUFACTURING SPEAKER

(71) Applicant: SEIKO EPSON CORPORATION, Tokyo (JP)

(72) Inventors: Satomi Yoshioka, Nagano (JP); Hisashi Koike, Nagano (JP); Nobutaka Urano, Nagano (JP); Tsukasa Ota, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 16/553,243

(22) Filed: Aug. 28, 2019

(65) Prior Publication Data

US 2020/0077217 A1 Mar. 5, 2020

(30) Foreign Application Priority Data

Aug. 30, 2018 (JP) ..... JP2018-162090
Aug. 30, 2018 (JP) ..... JP2018-162129

(51) Int. Cl.

| | |
|---|---|
| ***H04R 31/00*** | (2006.01) |
| ***H04R 9/06*** | (2006.01) |
| ***H04R 7/18*** | (2006.01) |
| ***H04R 9/04*** | (2006.01) |

(52) U.S. Cl.

CPC ..... *H04R 31/003* (2013.01); *H04R 7/18* (2013.01); *H04R 9/045* (2013.01); *H04R 9/06* (2013.01); *H04R 2307/029* (2013.01)

(58) Field of Classification Search

CPC ..... H04R 31/003; H04R 7/18; H04R 9/045; H04R 9/06; H04R 2307/029; H04R 2307/207; H04R 2307/204

See application file for complete search history.

(56) References Cited

U.S. PATENT DOCUMENTS

| | | | | |
|---|---|---|---|---|
| 5,744,761 A * | 4/1998 | Ogura | ..... | H04R 7/125 181/167 |
| 6,039,145 A | 3/2000 | Ogura et al. | | |
| 6,378,649 B1 | 4/2002 | Inoue et al. | | |
| 8,199,964 B2 * | 6/2012 | Mimura | ..... | H04R 31/003 381/428 |

(Continued)

FOREIGN PATENT DOCUMENTS

| | | |
|---|---|---|
| JP | 59-027627 A | 2/1984 |
| JP | 62-263798 A | 11/1987 |
| JP | 05-115094 A | 5/1993 |

(Continued)

*Primary Examiner* — Brian Ensey
(74) *Attorney, Agent, or Firm* — Global IP Counselors, LLP

(57) ABSTRACT

A speaker diaphragm includes a cone formed of a first material including first fibers derived from a plant and a first resin for binding the first fibers together, and an edge portion which is positioned at an outer peripheral portion of the cone and formed of a second material including a second resin, in which the cone and the edge portion are integrally formed. In addition, at least one of the content and the composition of the first resin and the second resin is different.

19 Claims, 23 Drawing Sheets

(56) References Cited

U.S. PATENT DOCUMENTS

| | | | | |
|---|---|---|---|---|
| 9,813,820 | B2 * | 11/2017 | Yuasa | H04R 1/028 |
| 2016/0234600 | A1 * | 8/2016 | Kajihara | B32B 29/02 |

FOREIGN PATENT DOCUMENTS

| | | | |
|---|---|---|---|
| JP | 07-184295 | A | 7/1995 |
| JP | 08-019092 | A | 1/1996 |
| JP | 08-140182 | A | 5/1996 |
| JP | 08-168093 | A | 6/1996 |
| JP | 11-187481 | A | 7/1999 |
| JP | 2001-204093 | A | 7/2001 |
| JP | 2004-328795 | A | 11/2004 |
| JP | 2006-311317 | A | 11/2006 |
| JP | 2017-103632 | A | 6/2017 |

* cited by examiner

SPEAKER DIAPHRAGM INCLUDING CONE FORMED OF MATERIAL INCLUDING FIBERS DERIVED FROM PLANT AND RESIN, SPEAKER UNIT, SPEAKER, AND METHOD FOR MANUFACTURING SPEAKER

The present application is based on, and claims priority from JP Application Serial Number 2018-162090, filed Aug. 30, 2018 and JP Application Serial Number 2018-162129, filed Aug. 30, 2018, the disclosures of which are hereby incorporated by reference herein in their entirety.

BACKGROUND

1. Technical Field

The present disclosure relates to a speaker diaphragm, a speaker unit, a speaker, and a method for manufacturing a speaker.

2. Related Art

A speaker is provided with a cone-shaped diaphragm (cone) having a circular opening in a center portion, a cylindrical voice coil bobbin inserted in the opening and adhered and fixed to the diaphragm by a liquid adhesive, a voice coil wound around the outer periphery of the voice coil bobbin, a permanent magnet installed on the outer periphery of the voice coil, a yoke bonded to the permanent magnet and forming a magnetic circuit, and a damper having a function of damping vibration. When an audio current corresponding to a sound source is input to the voice coil in the presence of a magnetic field generated by the permanent magnet, the voice coil bobbin vibrates in the central axis direction according to the audio current due to an electromagnetic induction action, the vibration is transmitted to the diaphragm, and sound waves are emitted from a sound wave emitting surface of the diaphragm.

In such a speaker, the diaphragm has a cone-shaped main body and a ring-shaped edge portion positioned on the outer peripheral portion of the main body. The edge portion is fixed to a frame. In addition, parts of the main body and the edge portion are fixed by an adhesive.

In addition, in the related art, the diaphragms in such speakers are formed of a paper material manufactured by a wet method to which various improvements to the structure and material have been made in order to improve the acoustic characteristics. Also, in order to improve the Young's modulus of the diaphragm, the surface layers provided on the sound wave emitting surfaces of such diaphragms contain cellulose nanofibers.

However, in the diaphragms of the related art as described above, in particular, the diaphragm described in JP-A-8-19092, there is a possibility that unevenness may also occur in the attachment amount of the adhesive at an adhesion fixing portion between the main body and the edge portion. There is a problem in that this causes the acoustic characteristics of the speaker to deteriorate.

In addition, in the diaphragms of the related art as described above, in particular, in the diaphragm described in JP-A-2017-103632, there is little impregnation of the liquid adhesive at the adhesion fixing portion for the voice coil, and it is necessary to apply a large amount of adhesive, therefore, unevenness occurs again in the attachment amount of the adhesive. There is a problem in that this causes the acoustic characteristics of the speaker to deteriorate.

SUMMARY

The present disclosure is able to be realized as follows.

According to an aspect of the present disclosure, a speaker diaphragm includes a cone formed of a first material including first fibers derived from a plant and a first resin for binding the first fibers together, and an edge portion positioned on an outer peripheral portion of the cone and formed of a second material including a second resin, in which the cone and the edge portion are integrally formed.

According to another aspect of the present disclosure, a speaker diaphragm includes a cone which has a main body formed of a first material including first fibers derived from a plant and a first resin for binding the first fibers together, and an edge portion bonding site, which is positioned on an outer peripheral portion of the main body, which is formed of a second material including a second resin, and to which an edge portion is bonded, in which a content ratio of the second resin in the second material is larger than a content ratio of the first resin in the first material.

According to another aspect of the present disclosure, a speaker unit includes the speaker diaphragm of the present disclosure, and a support portion which supports the edge portion of the speaker diaphragm.

According to another aspect of the present disclosure, a speaker includes a speaker diaphragm formed of a material including fibers derived from a plant and a resin for binding the fibers together, and a voice coil bobbin adhered to an inner peripheral portion of the speaker diaphragm by an adhesive.

According to another aspect of the present disclosure, a method for manufacturing a speaker is a method for manufacturing a speaker having a speaker diaphragm formed of a material including fibers derived from a plant and a resin which binds the fibers together, the method including forming a sheet formed of the material, forming the sheet in a cone shape, applying an adhesive to an inner peripheral portion of the speaker diaphragm, and adhering and fixing the speaker diaphragm to a voice coil bobbin by solidifying the adhesive.

According to another aspect of the present disclosure, a method for manufacturing a speaker is a method for manufacturing a speaker having a speaker diaphragm formed of a material including fibers derived from a plant and a resin which binds the fibers together, the method including depositing a web including the fibers and the resin in a cone shape, forming a deposit of the web by heating and pressing, applying an adhesive to an inner peripheral portion of the speaker diaphragm, and adhering and fixing the speaker diaphragm to a voice coil bobbin by solidifying the adhesive.

DESCRIPTION OF EXEMPLARY EMBODIMENTS

A detailed description will be given below of a speaker diaphragm and a speaker unit of the present disclosure based on preferred embodiments shown in the accompanying drawings.

First Embodiment

1. Speaker Configuration

Figure 1:
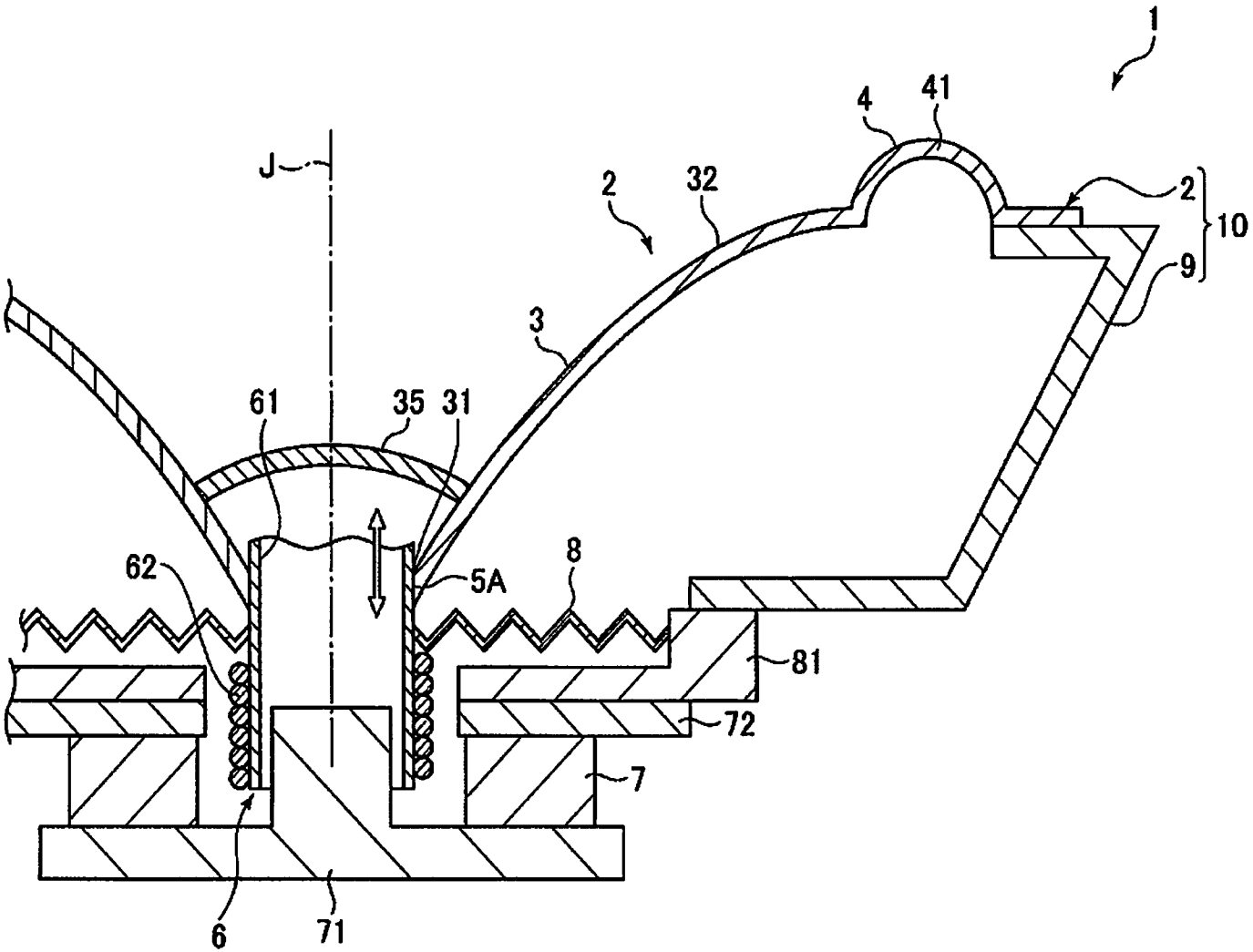
FIG. 1 is a longitudinal cross-sectional view which shows a first embodiment of a speaker provided with a speaker diaphragm and a speaker unit of the present disclosure.
Figure 2:
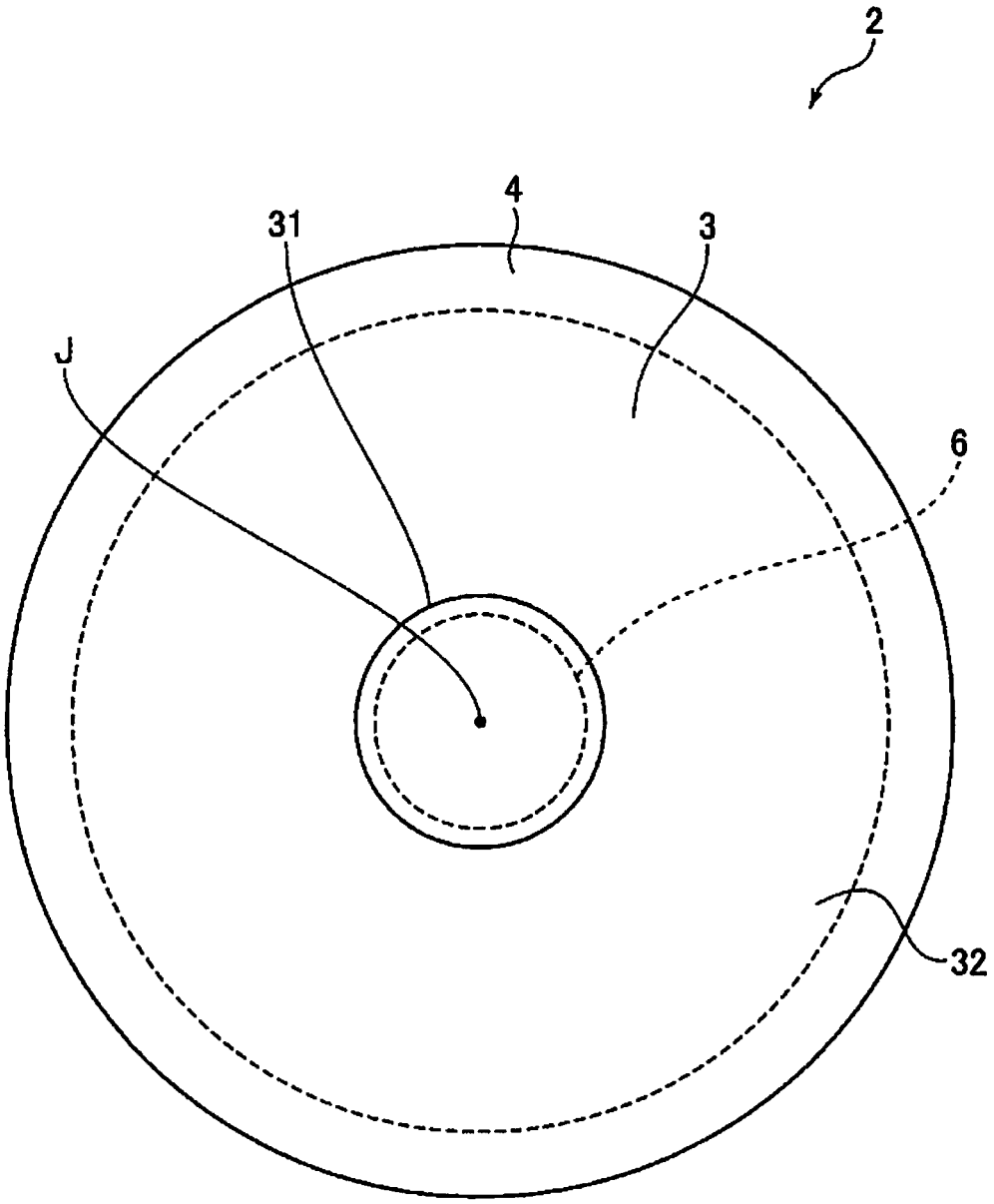
FIG. 2 is a plan view of the speaker diaphragm in the speaker shown in FIG. 1.
Figure 3:
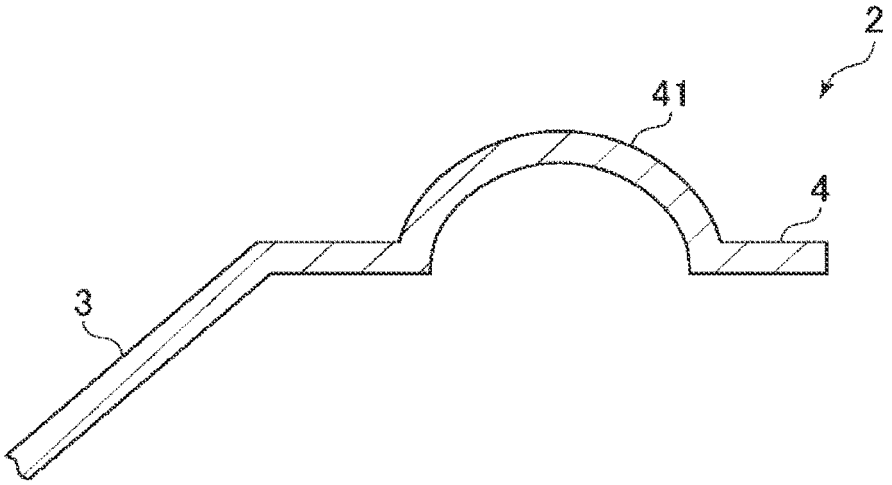
FIG. 3 is a longitudinal cross-sectional view which shows a boundary portion between a cone and an edge portion in the speaker shown in FIG. 1.
Figure 4:
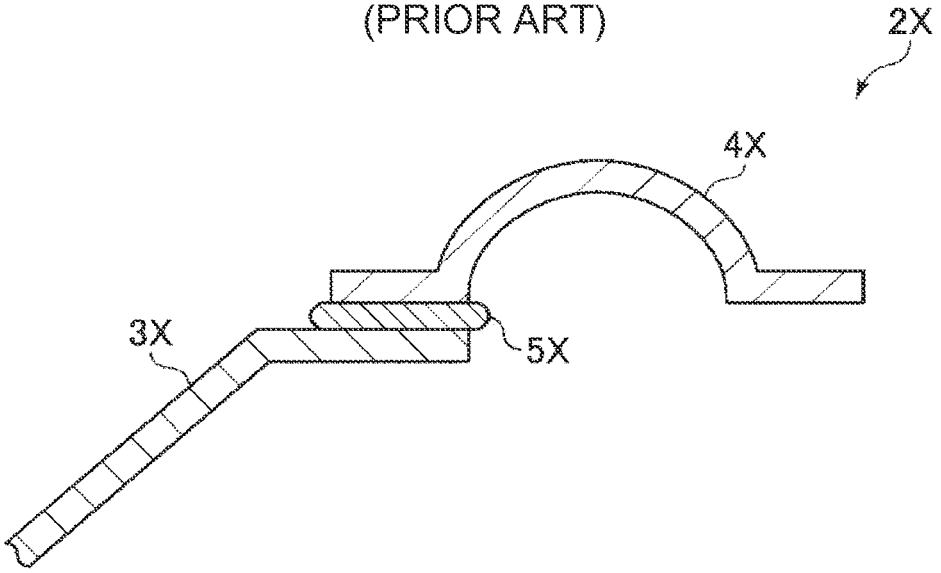
FIG. 4 (PRIOR ART)
FIG. 4 is a longitudinal cross-sectional view which shows a boundary portion between a cone and an edge portion in a speaker in the related art.

FIG. 1 is a longitudinal cross-sectional view which shows the first embodiment of a speaker provided with the speaker diaphragm and the speaker unit of the present disclosure. FIG. 2 is a plan view of the speaker diaphragm in the speaker shown in FIG. 1. FIG. 3 is a longitudinal cross-sectional view which shows a boundary portion between a cone and an edge portion in the speaker shown in FIG. 1. FIG. 4 is a longitudinal cross-sectional view which shows a boundary portion between a cone and an edge portion in a speaker in the related art.

Below, for convenience of explanation, the upper side of FIG. 1, FIG. 2, FIG. 3, and FIG. 4 is referred to as "top" or "upper", and the lower side as "bottom" or "lower".

As shown in FIG. 1, a speaker 1 is provided with a speaker diaphragm 2 of the present disclosure, a vibrator 6, a permanent magnet 7, a yoke 71, a top plate 72, a damper 8, a ring member 81, and a frame 9. In addition, a speaker unit 10 of the present disclosure is formed by the speaker diaphragm 2 and the frame 9. Applications for the speaker diaphragm 2, the speaker unit 10 and the speaker 1 provided with the same are not particularly limited, and examples thereof include woofers, tweeters, and full range speakers.

The speaker diaphragm 2 has a cone 3 and an edge portion 4 positioned on an outer peripheral portion of the cone 3. The general shape of the cone 3 is of a body which rotates with respect to a central axis J, in particular, a substantially truncated cone shape. Here, the upper surface in FIG. 1 of the cone 3, that is, the inner surface, forms a sound wave emitting surface 32, and, as the sound wave emitting surface 32 goes upward, the distance from the central axis J gradually increases. In addition, as the sound wave emitting surface 32 goes upward, the angle with respect to the central axis J gradually increases.

As shown in FIG. 1, in the lower portion of the cone 3, that is, in the central portion (edge portion positioned on the inner peripheral portion side), a circular opening 31 into which a voice coil bobbin 61 is inserted is formed. Below, the shape of the cone 3 having the sound wave emitting surface 32 and the opening 31 as described above is referred to as a "cone shape". In addition, the cone shape in the state in which the opening 31 is not yet formed is referred to as a "cone shape without an opening."

In addition, the shape of the sound wave emitting surface 32 is not limited to the illustrated shape and may be a shape which has, for example, a stepped portion or a wave shape in a longitudinal end surface view.

The outer diameter of the cone 3 is not particularly limited, but is preferably 10 mm or more and 800 mm or less, and more preferably 15 mm or more and 600 mm or less.

The inner diameter (diameter of the opening 31) of the cone 3 is not particularly limited, but is preferably 3 mm or more and 200 mm or less, and more preferably 5 mm or more and 150 mm or less.

The edge portion 4 has a circular shape centered on the central axis J. In addition, the edge portion 4 has a curved convex portion 41 which protrudes upward in the longitudinal end surface view of FIG. 1. The curved convex portion 41 is deformed in accordance with the vibration of the cone 3. The edge portion 4 is formed of a material having flexibility, plasticity, or elasticity.

The outer peripheral portion of the edge portion 4 is fixed to the upper portion of the frame 9 by a method such as adhesion with an adhesive or fusion.

The speaker 1 is provided with the vibrator 6 having a cylindrical voice coil bobbin 61 and a voice coil 62 wound around and mounted around the outer peripheral portion of the voice coil bobbin 61. The edge portion of the opening 31 of the cone 3, that is, the inner peripheral portion of the speaker diaphragm 2, is adhered and fixed to the outer peripheral surface of the voice coil bobbin 61 above the voice coil 62 via an adhesive 5A. As the adhesive 5A, it is possible to use, for example, various types of adhesive such as a thermosetting adhesive, a photocurable adhesive, and a hot melt adhesive.

A cap 35 is mounted on a lower portion inside the cone 3 so as to cover an upper end opening of the voice coil bobbin 61. The outer peripheral edge of the cap 35 is fixed to the sound wave emitting surface 32 of the cone 3 by an adhesive, for example.

On the outer peripheral portion of the voice coil 62, the permanent magnet 7, the yoke 71 bonded to the permanent magnet 7, the top plate 72 installed on the upper portion of the permanent magnet 7, and the ring member 81 formed on the upper portion of the top plate 72 are installed without contacting the voice coil 62. The permanent magnet 7, the yoke 71, and the top plate 72 form a magnetic circuit around the voice coil 62.

When an electric signal, that is, an audio current corresponding to a sound source, is input to the voice coil 62, the vibrator 6 vibrates in the vertical direction (the central axis J direction) according to the audio current due to an electromagnetic induction action, this vibration is transmitted to the cone 3, the air in the vicinity of the sound wave emitting surface 32 the cone 3 vibrates, and sound waves are emitted.

The ring-shaped damper 8 is installed on the outer peripheral portion of the voice coil bobbin 61. The damper 8 is flexible and has a function of damping vibration. The inner peripheral portion of the damper 8 is fixed to the outer peripheral surface of the voice coil bobbin 61 by, for example, adhesion with an adhesive, and the outer peripheral portion of the damper 8 is fixed to the ring member 81 by, for example, adhesion with an adhesive. In addition, the outer peripheral portion of the ring member 81 is fixed to the lower portion of the frame 9.

The vibrator 6 and the cone 3 bonded thereto are supported by the edge portion 4 and the damper 8 so as to be able to vibrate in the vertical direction with respect to the frame 9. The edge portion 4 and the damper 8 support the vibrator 6 and the cone 3 such that the vibrator 6 does not contact the permanent magnet 7, the top plate 72, and the like when the vibrator 6 vibrates. Due to this, it is possible for the cone 3 to vibrate smoothly and with good responsiveness with respect to the input of the audio current to the voice coil 62.

The configuration of the speaker 1 was described above.

In addition, the speaker unit 10 of the present disclosure is formed by the speaker diaphragm 2 and the frame 9 (supporting portion) which supports the edge portion 4. Due to this, it is possible to obtain the effect of the present disclosure described below. The speaker unit 10 may be provided with each of the components described above of the speaker 1, that is, the vibrator 6, the permanent magnet, the yoke 71, the top plate 72, the damper 8, and the ring member 81.

2. Constituent Material of Cone

Next, an explanation will be given of the first material which is a constituent material of the cone 3.

The first material which forms the cone 3 is formed by a material including first fibers derived from a plant, and a first resin which binds the fibers together.

Examples of fibers derived from a plant include cellulose fibers, cotton, linter, kapok, flax, hemp, ramie, silk, and the like, and it is possible to use one type or two or more types of the above in combination; however, among the above, fibers which are mainly cellulose fibers are preferable. Cellulose fibers are easy to obtain the moldability into the cone 3 is excellent, and good acoustic characteristics are obtained in the obtained cone 3. As the cellulose fibers, cellulose fibers derived from wood pulp are preferable. Examples of wood pulps include virgin pulp, kraft pulp, bleached chemi-thermomechanical pulp, synthetic pulp, pulp derived from used paper and recycled paper, and the like, and it is possible to use one type or two or more types of the above in combination. Here, it is sufficient if the cellulose fibers are cellulose as a compound, that is, fibers having cellulose as a main component and having a fibrous form in a narrow sense, and correspond to cellulose fibers including hemicellulose and lignin, in addition to cellulose in a narrow sense.

The first fibers may include fibers not derived from a plant. Examples thereof include fibers derived from animals such as wool, resin fibers such as polyamide, tetron, rayon, cupra, acetate, vinylon, acrylic, polyethylene terephthalate, and aramid, glass fibers, carbon fibers, and the like.

The average fiber length of the first fibers is not particularly limited, but is preferably 0.001 mm or more and 500 mm or less, and more preferably 0.005 mm or more and 200 mm or less. Due to this, binding is favorably carried out using the first resin described below, the moldability is excellent, and appropriate rigidity is obtained.

The average fiber width of the first fibers is not particularly limited, but is preferably 0.1 μm or more and 1000 μm or less, and more preferably 1 μm or more and 500 μm or less. Due to this, binding is favorably carried out using the first resin described below, the moldability is excellent, and appropriate rigidity is obtained.

In addition, for the same reason, the average aspect ratio of the first fibers, that is, the ratio of the average fiber length with respect to the average fiber width is preferably 2 or more and 1000 or less, and more preferably 10 or more and 600 or less.

The content of the first fibers in the constituent material of the cone 3 is not particularly limited, but is preferably 20% by weight or more and 90% by weight or less, and more preferably 30% by weight or more and 75% by weight or less. With such a content, it is possible to obtain the cone 3 which is excellent in moldability into a cone shape, which is lightweight, and which has sufficient rigidity. Furthermore, when the edge portion of the opening 31 of the cone 3 is adhered to the outer peripheral surface of the voice coil bobbin 61 with the adhesive 5A, there is also an advantage in that it is possible to sufficiently preserve the impregnation property of the uncured liquid adhesive and to obtain good adhesion and fixing.

In addition, in the constituent material of the cone 3, the content of fibers derived from a plant, in particular, cellulose fibers, in all of the first fibers is not particularly limited, but is preferably 60% by weight or more and 100% by weight or less, and more preferably 75% by weight or more and 100% by weight or less.

As the first resin for binding the first fibers together, that is, as a first binding resin, it is possible to use any thermoplastic resin or curable resin, but it is preferable to mainly use a thermoplastic resin. Examples of thermoplastic resins include AS resin, ABS resin, polyethylene, polypropylene, polyolefin such as ethylene-vinyl acetate copolymer (EVA), modified polyolefin, acrylic resin such as polymethyl methacrylate, polyvinyl chloride, polystyrene, polyester such as polyethylene terephthalate and polybutylene terephthalate, polyamides (nylon: registered trademark) such as nylon 6, nylon 46, nylon 66, nylon 610, nylon 612, nylon 11, nylon 12, nylon 6-12, and nylon 6-66, liquid crystal polymers such as polyamideimide, polyphenylene ether, polyacetal, polyether, polyphenylene oxide, modified polyphenylene ether, polyetheretherketone, polycarbonate, polyphenylene sulfide, thermoplastic polyimide, polyetherimide, and aromatic polyester, fluorine-based resins such as polytetrafluoroethylene, various thermoplastic elastomers such as styrenes, polyolefins, polyvinyl chlorides, polyurethanes, polyesters, polyamides, polybutadienes, trans polyisoprenes, fluororubbers, and chlorinated polyethylenes, and it is possible to use one type or two or more types of the above in combination. Polyesters or resins including the same are particularly preferable thermoplastic resins. In addition, biomass plastic and biodegradable plastic such as polylactic acid, polycaprolactone, modified starch, polyhydroxybutyrate, polybutylene succinate, and polybutylene succinate adipate may be included. Due to this, the environmental compatibility is improved. In addition, a curable resin such as a thermosetting resin or a photocurable resin may be included. Examples of thermosetting resins include epoxy resins and phenol resins and one type or two or more types thereof may be included.

The form of the first resin contained in the first material is not particularly limited, but addition as a powder is preferable. In particular, the first resin is preferably added as a powder having an average particle diameter (weight average particle diameter) of 0.1 μm or more and 120 μm or less, and more preferably as a powder having an average particle diameter of 1 μm or more and 50 μm or less. Due to this, it is easy to uniformly disperse the first resin with respect to the first fibers and it is possible to obtain the cone 3 without unevenness in the rigidity or vibration characteristics.

The content of the first resin in the first material is not particularly limited, but is preferably 15% by weight or more and 50% by weight or less, and more preferably 18% by weight or more and 40% by weight or less. With such a content, it is possible to obtain the cone 3 in which the first fibers are sufficiently bound, the moldability is also good, and which is lightweight and has the necessary and sufficient rigidity. Furthermore, when the edge portion of the opening 31 of the cone 3 is adhered to the outer peripheral surface of the voice coil bobbin 61 with the adhesive 5A, there is also an advantage in that it is possible to sufficiently preserve the impregnation property of the uncured liquid adhesive and to obtain good adhesion and fixing.

3. Constituent Material of Edge Portion

Next, a description will be given of a second material which is a constituent material of the edge portion 4.

The edge portion 4 has rigidity so as to be able to maintain a shape by itself, but has lower rigidity than the cone 3 and has appropriate vibration damping properties. For this reason, it is possible to exhibit excellent acoustic characteristics as the speaker diaphragm 2 as a whole. In the present embodiment, it is possible to realize a difference in rigidity between the cone 3 and the edge portion 4 by the following configuration.

The second material which forms the edge portion 4 is formed of a material including second fibers and a second resin (a second binding resin) which binds the second fibers together.

Examples of the second fibers are not particularly limited, but include fibers derived from a plant, fibers derived from an animal, resin fibers, glass fibers, carbon fibers, and the like, it is possible to use one type or two or more types of the above in combination, and, among the above, fibers derived from a plant are preferable.

Examples of fibers derived from a plant include cellulose fibers, cotton, linter, kapok, flax, hemp, ramie, silk, and the like, it is possible to use one type or two or more types of the above in combination, and, among the above, fibers which are mainly cellulose fibers are preferable. Cellulose fibers are easy to obtain, the moldability into the edge portion 4 is excellent, and it is possible to obtain good acoustic characteristics for the obtained edge portion 4. As the cellulose fibers, fibers derived from wood pulp are preferable. Examples of wood pulps include virgin pulp, kraft pulp, bleached chemi-thermomechanical pulp, synthetic pulp, pulp derived from used paper and recycled paper, and the like, and it is possible to use one type or two or more types of the above in combination.

In addition, examples of fibers derived from an animal include wool and the like. In addition, examples of resin fibers include polyamide, tetron, rayon, cupra, acetate, vinylon, acrylic, polyethylene terephthalate, aramid, and the like.

The average fiber length of the second fibers is shorter than the average fiber length of the first fibers. Due to this, the rigidity of the edge portion 4 is less than the cone 3. The average fiber length of the second fibers is not particularly limited, but is preferably 0.0005 mm or more and 400 mm or less, and more preferably 0.004 mm or more and 150 mm or less. Due to this, the binding with the second resin to be described below is favorably performed, the moldability is excellent, and appropriate flexibility is obtained.

The average fiber width of the second fibers is shorter than the average fiber width of the first fibers. Due to this, the rigidity of the edge portion 4 is less than that of the cone 3. The average fiber width of the second fibers is not particularly limited, but is preferably 0.05 μm or more and 800 μm or less, and more preferably 0.8 μm or more and 400 μm or less. Due to this, the binding with the second resin to be described below is favorably performed, the moldability is excellent, and appropriate flexibility is obtained.

In addition, for the same reason, the average aspect ratio of the first fibers, that is, the ratio of the average fiber length to the average fiber width is preferably 2 or more and 1000 or less, and more preferably 10 or more and 600 or less.

The content of the second fibers in the second material is not particularly limited, but is preferably 20% by weight or more and 85% by weight or less, and more preferably 30% by weight or more and 70% by weight or less. With such a content, it is possible to obtain the edge portion 4 which is excellent in moldability, which is lightweight, and which has sufficient flexibility. Furthermore, when bonding the outer peripheral portion of the edge portion 4 to the frame 9, it is possible to sufficiently ensure the bonding strength. In particular, in a case where the edge portion 4 is fixed to the frame 9 via an adhesive, it is possible to sufficiently preserve the permeability of the uncured adhesive (liquid adhesive) and to sufficiently increase the adhesive strength.

In addition, in the second material, the content of the fibers derived from a plant, in particular, cellulose fibers, in all of the second fibers is not particularly limited, but is preferably 60% by weight or more and 100% by weight or less, and more preferably 75% by weight or more and 100% by weight or less.

The first fibers and the second fibers may have the same or different conditions, that is, the content, the composition, and the average fiber length and width, but preferably at least one of the above conditions is different. Due to this, along with the setting of the conditions (content and composition) of the first resin and the second resin, it is possible to realize a difference in rigidity between the cone 3 and the edge portion 4 and to realize excellent acoustic characteristics and sound quality stability. In addition, for example, in a case of manufacturing the first fibers and the second fibers with a dry method, it is possible to obtain the desired first fibers and the second fibers by a simple method of varying the degree of defibration or appropriately selecting the raw material to be supplied.

Although it is possible to use any thermoplastic resin or curable resin as the second resin for binding the second fibers together, that is, the second binding resin, it is preferable to mainly use a thermoplastic resin. Examples of thermoplastic resins include AS resin, ABS resin, polyethylene, polypropylene, polyolefins such as ethylene-vinyl acetate copolymer (EVA), modified polyolefin, acrylic resin such as polymethyl methacrylate, polyvinyl chloride, polystyrene, polyesters such as polyethylene terephthalate and polybutylene terephthalate, polyamide (nylon: registered trademark) such as nylon 6, nylon 46, nylon 66, nylon 610, nylon 612, nylon 11, nylon 12, nylon 6-12, and nylon 6-66, liquid crystal polymers such as polyamideimide, polyphenylene ether, polyacetal, polyether, polyphenylene oxide, modified polyphenylene ether, polyetheretherketone, polycarbonate, polyphenylene sulfide, thermoplastic polyimide, polyetherimide and aromatic polyester, fluorine-based resins such as polytetrafluoroethylene, styrenes, polyolefins, polyvinyl chlorides, polyurethanes, polyesters, polyamides, polybutadienes, trans polyisoprenes, various thermoplastic elastomers such as fluororubbers and chlorinated polyethylenes, and it is possible to use one type or two or more types of the above in combination. Polyesters or resins including the same are particularly preferable thermoplastic resins. In addition, biomass plastic and biodegradable plastic such as polylactic acid, polycaprolactone, modified starch, polyhydroxybutyrate, polybutylene succinate, and polybutylene succinate adipate may be included. Due to this, the environmental compatibility is improved. In addition, a curable resin such as a thermosetting resin or a photocurable resin may be included. Examples of thermosetting resins include epoxy resins and phenol resins and one type or two or more types thereof may be included.

In addition, the first resin and the second resin may have the same or different conditions, that is, the content and the composition, but at least one of the conditions is preferably different. Due to this, along with the setting of the conditions (content, composition, average fiber length, and width) of the first fibers and the second fibers, it is possible to realize a difference in rigidity between the cone 3 and the edge portion 4 and to realize excellent acoustic characteristics and sound quality stability. In addition, in a case where the first material or the second material is obtained by mixing a granular resin with fibers, it is possible to obtain the desired first material or second material by a simple method of appropriately selecting the type of resin to be mixed or adjusting the mixing amount.

The form of the second resin contained in the second material is not particularly limited, but addition as a powder is preferable. In particular, the first resin is preferably added as a powder having an average particle diameter (weight average particle diameter) of 1 μm or more and 120 μm or less, and more preferably as a powder having an average particle diameter of 0.1 μm or more and 50 μm or less. Due to this, it is easy to uniformly disperse the first resin with respect to the first fibers and it is possible to obtain the cone 3 without unevenness in the rigidity or vibration characteristics.

The content of the second resin in the second material is not particularly limited, but is preferably 10% by weight or more and 60% by weight or less, and more preferably 15% by weight or more and 50% by weight or less. With such a content, it is possible to obtain the edge portion 4 in which the second fibers are sufficiently bound, the moldability is also good, and which is lightweight and has sufficient flexibility.

According to the speaker diaphragm 2 having the cone 3 and the edge portion 4 as described above, it is possible for the cone 3 and the edge portion 4 to each have different characteristics. Thus, it is possible to obtain good acoustic characteristics.

Further, since the cone 3 and the edge portion 4 are integrally formed, the present disclosure has the following advantages.

In a speaker diaphragm 2X of the related art shown in FIG. 4, a cone 3X and an edge portion 4X are fixed to each other via an adhesive 5X in a state of being partially overlapped. Depending on the type of the adhesive 5X, the thickness unevenness of the adhesive 5X, and the like, the acoustic characteristics and the sound quality stability may be lowered. In particular, the speaker diaphragm 2X of the related art is manufactured by a wet (wet method) papermaking method and does not include a resin in the constituent materials thereof and there is a tendency for the pulp fibers to orient in a certain direction. In such a case, when the uncured liquid adhesive 5X is coated on the cone 3X or the edge portion 4X, the permeability is poor, thus, it is necessary to apply a large amount of the adhesive 5X to obtain sufficient adhesive strength and thickness unevenness easily occurs. Moreover, depending on the degree of this unevenness, the adhesive strength is also insufficient. In addition, as shown in FIG. 4, the adhesive 5X may also protrude. As described above, due to the large amount of the adhesive 5X remaining and the unevenness of the remaining amount, the acoustic characteristics and the sound quality stability are adversely affected in the speaker of the related art provided with the speaker diaphragm 2X. The individual differences at the time of manufacturing a plurality of speakers are also significant.

On the other hand, in the present disclosure, the cone 3 and the edge portion 4 are integrally formed by a manufacturing method described below. Due to this, it is possible to omit the adhesive which adheres a cone and edge portion as in the related art. Thus, it is possible to prevent malfunctions due to the adhesive, the sound quality stability improves, and it is possible to obtain favorable acoustic characteristics. For such an effect, there are few individual differences at the time of manufacturing a plurality of the speakers 1.

In addition, the first fibers in the first material and the second fibers in the second material are preferably randomly arranged, that is, randomly oriented. Here, random orientation is synonymous with a low degree of orientation.

In order to make the orientations of the first fibers and the second fibers random, the cone 3 and the edge portion 4 are preferably manufactured with a dry method, that is, using dry fiber technology, as in the manufacturing method described below. That is, the first fibers and the second fibers are preferably fibers based on a defibrated material subjected to defibration by a dry method.

By the first fibers being randomly oriented, when the edge portion of the opening 31 of the cone 3 is adhered to the outer peripheral surface of the voice coil bobbin 61 with an adhesive, the impregnation property of the uncured liquid adhesive into the cone 3 is good, thus, it is possible to perform the adhesion uniformly through the application of a small amount of adhesive. As a result, the sound quality stability is improved and it is possible to obtain good acoustic characteristics.

Furthermore, due to the second fibers being randomly oriented, in a case where the edge portion 4 is fixed to the frame 9 with an adhesive, the impregnation property of the uncured liquid adhesive into the edge portion 4 is good, thus, it is possible to carry out uniform adhesion by applying a small amount of adhesive. As a result, the sound quality stability is improved and it is possible to obtain good acoustic characteristics.

The first material may include components other than the first fibers and the first resin. In addition, components other than a second fibers and second resin may be included in second material. Examples of these components include neutralizing agents, fixing agents, tackifiers, sizing agents, paper strengthening agents, antifoaming agents, water retention agents, water resistance agents, aggregation suppressing agents for suppressing the aggregation of fibers and aggregation of resins, colorants such as carbon black and white pigments, flame retardants, and the like.

The average thickness of the cone 3 and the edge portion 4 is not particularly limited, but is preferably 0.15 mm or more and 2.0 mm or less, and more preferably 0.2 mm or more and 1.7 mm or less. Due to this, it is possible to obtain the lightweight speaker diaphragm 2 with good responsiveness and having a desired rigidity, which contributes to the improvement of the acoustic characteristics.

In addition, the thicknesses of the cone 3 and the edge portion 4 are not limited to a case where the thickness is uniform throughout, and there may be portions having different thicknesses or portions having a gradually changing thickness. For example, from the inner peripheral portion of the cone 3 to the outer peripheral portion, that is, from a portion closer to the central axis J to a portion farther from the central axis J, there may be places where the thickness gradually decreases or gradually increases.

As described above, the speaker diaphragm 2 is provided with the cone 3 formed of the first material including the first fibers derived from a plant and the first resin for binding the first fibers together, and the edge portion 4 positioned on the outer peripheral portion of the cone 3 and formed of a second material including a second resin. In addition, the cone 3 and the edge portion 4 are integrally formed. Due to this, it is possible for the cone 3 and the edge portion 4 to have different characteristics and it is possible to omit the adhesive which adheres a cone and edge portion as in the related art. Thus, eliminating the unevenness and the protrusion at the time of applying the adhesive improves the sound quality stability and makes it possible to obtain good acoustic characteristics. For such an effect, there are few individual differences at the time of manufacturing a plurality of the speakers 1.

4. Method for Manufacturing Speaker Diaphragm

Figure 5:
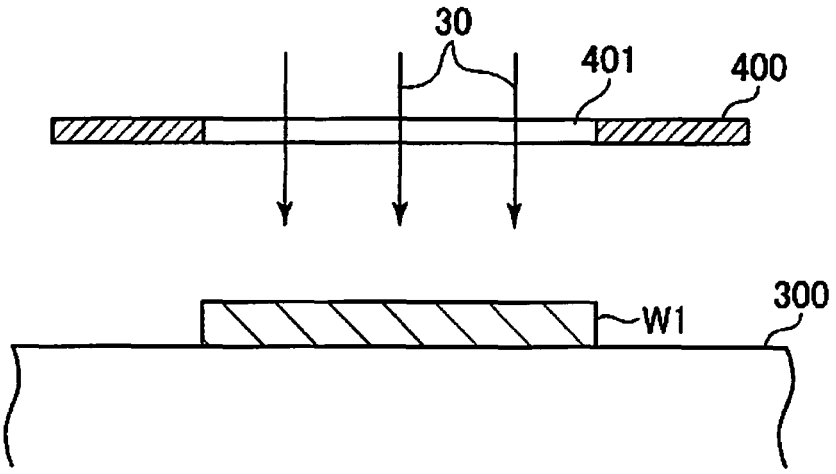
FIG. 5 is a cross-sectional view for illustrating a method for manufacturing the speaker diaphragm shown in FIG. 1, which shows a step of obtaining a first deposit.
Figure 6:
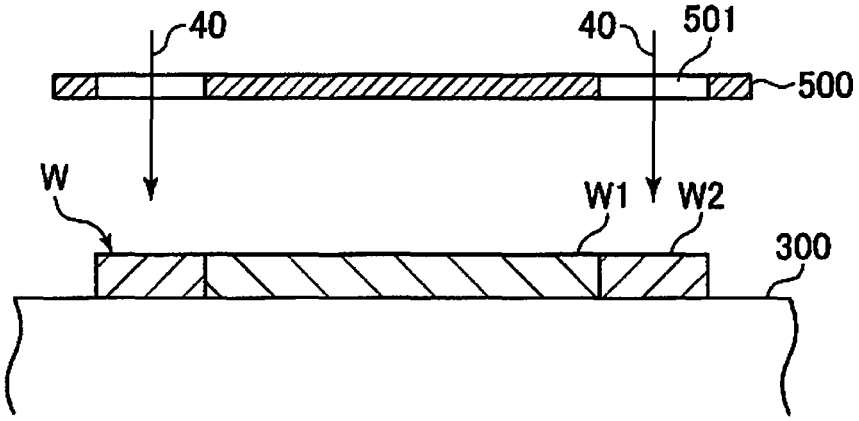
FIG. 6 is a cross-sectional view for illustrating the method for manufacturing the speaker diaphragm shown in FIG. 1, which shows a step of obtaining a second deposit.
Figure 7:
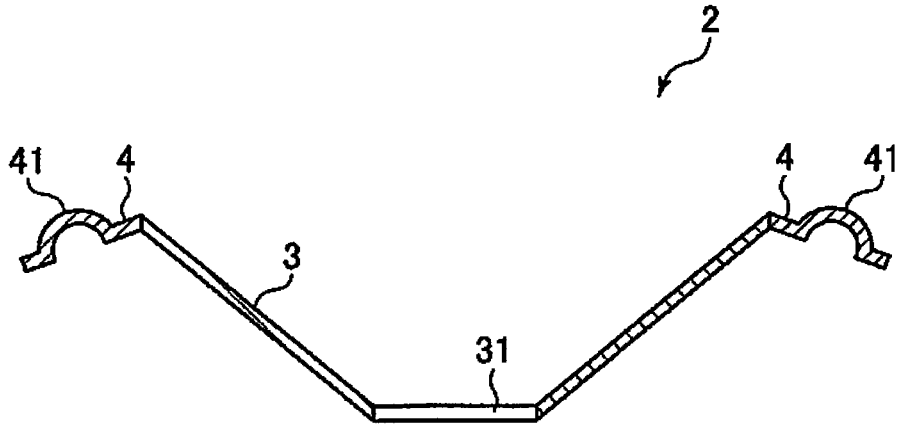
FIG. 7 is a cross-sectional view of a speaker diaphragm formed of the deposits obtained through the steps shown in FIG. 5 and FIG. 6.

FIG. 5 is a cross-sectional view for illustrating a method for manufacturing the speaker diaphragm shown in FIG. 1, which shows a step of obtaining a first deposit. FIG. 6 is a cross-sectional view for illustrating the method for manufacturing the speaker diaphragm shown in FIG. 1, which shows a step of obtaining a second deposit. FIG. 7 is a cross-sectional view of a speaker diaphragm formed of the deposits obtained through the steps shown in FIG. 5 and FIG. 6.

Below, for convenience of explanation, the upper side in FIG. 5 to FIG. 7 may be referred to as "top" or "upper" and the lower side as "bottom" or "lower", the upper left side may be referred to as "left" or "upstream", and the upper right side as "right" or "downstream".

First, as shown in FIG. 5, a first material 30 in which cotton-like fibers and a granular resin are mixed is deposited on a mounting table 300 to obtain a first deposit W1 (first deposition step). The first deposit W1 is the portion which later becomes the cone 3 through pressing, heating, and forming steps.

This step is performed using a first mask 400 having through-holes 401. The through-holes 401 have a circular shape in a plan view of the first mask 400 and the first material 30, which is dispersed from above the through-holes 401, is deposited in a circular shape on the mounting table 300.

The first material 30 is manufactured using, for example, a dry apparatus as disclosed in JP-A-2018-86701. Adjusting the operation of the defibrating portion and the resin supply portion of this apparatus makes it possible to obtain the first material 30 under the desired conditions.

Next, as shown in FIG. 6, a second material 40 in which cotton-like fibers and a granular resin are mixed is deposited on the mounting table 300 and on the outer peripheral side of the first deposit W1, and a second deposit W2 is obtained (second step).

This step is performed using a second mask 500 having through-holes 501. The through-holes 501 have a circular shape in a plan view of the second mask 500 and the second material 40, which is dispersed from above the through-holes 501, is deposited in a circular shape on the mounting table 300.

Through the first step and second step, the first deposit W1 and the second deposit W2 are deposited on the mounting table 300, and one circular deposit W is formed in a plan view.

The second material 40 is in a state in which the cotton-like second fibers and the granular second resin are mixed and is manufactured using a dry apparatus as shown in JP-A-2018-86701, for example. Adjusting the operation of the defibrating portion and the resin supply portion of this apparatus makes it possible to obtain the second material 40 under the desired conditions.

Then, although not shown, the deposit W is pressed to form, for example, a sheet and the sheet is heated and pressed using a mold having a concave cavity corresponding to a cone shape to form the sheet into a cone shape, then, the central portion is punched in a circular shape to form the opening 31 so as to obtain the speaker diaphragm 2 as shown in FIG. 7.

In addition, the heating and pressing may be performed at the same time, or may be performed at different timings. In a case where the heating and pressing are performed simultaneously, example methods include a method of pressing while heating using a heating block (mold). In a case where the heating and pressing are performed at different timings, example heating methods include a method of heating in an oven, steam heating, microwave heating, and the like.

At the time point when the deposit W is pressed to form a sheet, the first fibers and the second fibers at the boundary between the first deposit W1 and the second deposit W2 form a sheet in a state of being intertwined, and the first material and the second material are in an integrally formed state as a result. Then, the first resin and the second resin are melted by heating and pressing this sheet, and the melted first resin binds the first fibers together and the second resin binds the second fibers together. Furthermore, the first resin and the second resin in the vicinity of the boundary portion between the first material and the second material are bound together, and as a result, the cone 3 and the edge portion 4 are firmly integrally formed.

In addition, the speaker diaphragm 2 provided with the cone 3 and the edge portion 4 having a difference in rigidity is obtained by a simple method of selecting the conditions of the first material 30 and the second material 40 and the deposition positions of the first material 30 and the second material 40.

Second Embodiment

Figure 8:
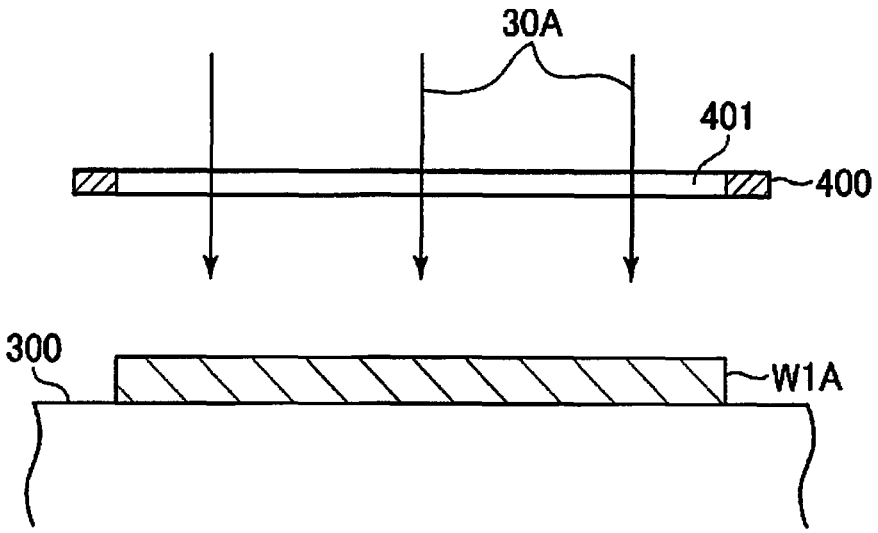
FIG. 8 is a cross-sectional view for illustrating a method for manufacturing a speaker diaphragm according to a second embodiment of the present disclosure, which shows a step of obtaining a first deposit.
Figure 9:
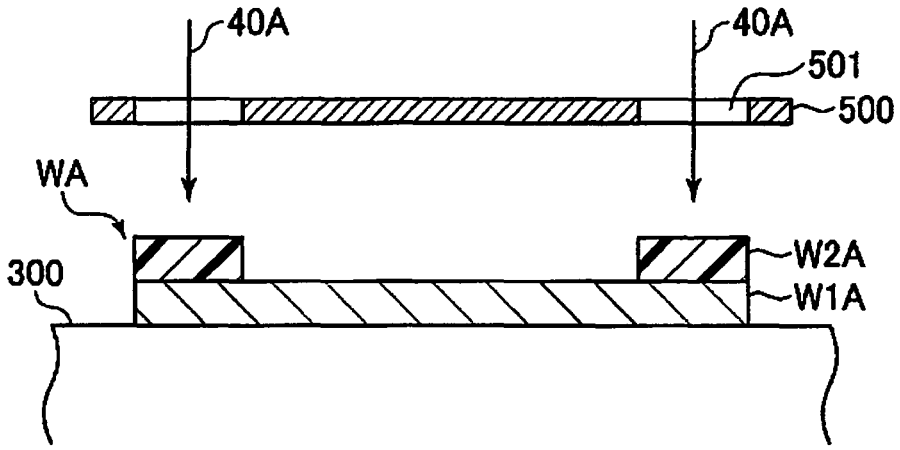
FIG. 9 is a cross-sectional view for illustrating the method for manufacturing a speaker diaphragm according to the second embodiment of the present disclosure, which shows a step of obtaining a second deposit.
Figure 10:
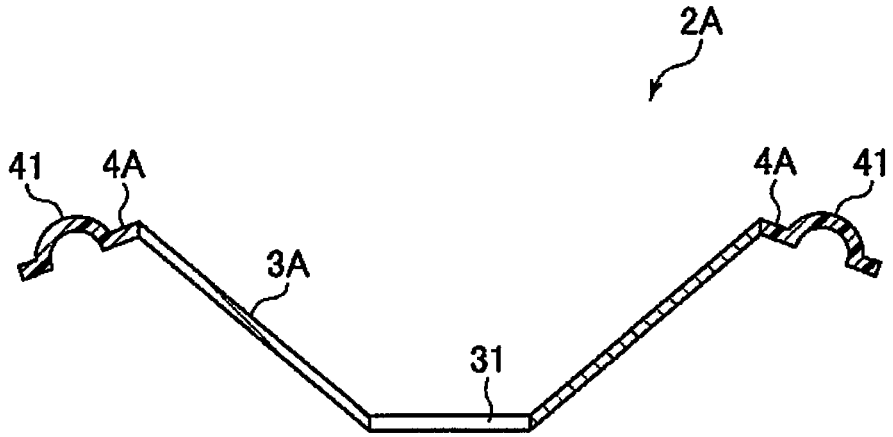
FIG. 10 is a cross-sectional view of a speaker diaphragm formed of the deposits obtained through the steps shown in FIG. 8 and FIG. 9.

FIG. 8 is a cross-sectional view for illustrating a method for manufacturing a speaker diaphragm according to the second embodiment of the present disclosure, which shows a step of obtaining a first deposit. FIG. 9 is a cross-sectional view for illustrating the method for manufacturing a speaker diaphragm according to the second embodiment of the present disclosure, which shows a step of obtaining a second deposit. FIG. 10 is a cross-sectional view of a speaker diaphragm formed of the deposits obtained through the steps shown in FIG. 8 and FIG. 9.

A description will be given below of the second embodiment with reference to these drawings, but explanation will be given focusing mainly on differences from the first embodiment described above and explanation of the points of similarity will be omitted.

A speaker diaphragm 2A of the present embodiment is the same as the first embodiment except for the configuration of the speaker diaphragm 2A and the manufacturing method thereof.

In the speaker diaphragm 2A shown in FIG. 10, a first material 30A of a cone 3A and a second material 40A of an edge portion 4A are different. Specifically, in the first material 30A and the second material 40A, the condition of the first fibers and the second fibers, that is, the content, the composition, and the average fiber length and the width are the same, but the conditions of first resin and the second resin, that is, the composition and content, are different. The second resin includes a resin of the same type as the first resin, and a resin having a higher elastic modulus than the first resin. Due to this, the edge portion 4A is more flexible than the cone 3A. Therefore, it is possible to obtain the same effect as that of the first embodiment and to obtain the speaker diaphragm 2A by a simple method of selecting the conditions of the second resin.

The resin included in the second resin and having a higher elastic modulus than the first resin is not particularly limited, and examples thereof include the resin materials described above or a resin capsule (thermal expansion capsule) in which hydrocarbons are encapsulated, or the like.

The content of the second resin in the second material is not particularly limited, but is preferably 10% by weight or more and 50% by weight or less, and more preferably 15% by weight or more and 45% by weight or less. With such a content, it is possible to obtain the edge portion 4A in which the binding of the second fibers is sufficiently performed, the moldability is also good, and which is lightweight and has necessary and sufficient flexibility.

Next, a description will be given of a method for manufacturing the speaker diaphragm 2A.

As shown in FIG. 8, the first material 30A in which cotton-like fibers and a granular resin are mixed is deposited on the mounting table 300 to obtain a first deposit W1A (first deposition step).

This step is performed using the first mask 400 having the through-holes 401. The through-holes 401 have a circular shape in a plan view of the first mask 400 and the first material 30A, which is dispersed from above the through-holes 401, is deposited in a circular shape on the mounting table 300.

The first material 30A is obtained in the same manner as the first material 30 of the embodiment above.

Next, as shown in FIG. 9, a resin 40A is deposited on the first deposit W1A and on the edge portion of the first deposit W1A to obtain a second deposit W2A (second step).

The form of the resin 40A may be, for example, a solid which is granular, fibrous, or the like, or may be a liquid. In the case of a liquid, the liquid resin is impregnated in the first deposit W1A and the fibers and the resin are further mixed in the obtained edge portion 4 in a favorable and uniform manner.

This step is performed using the second mask 500 having the through-holes 501. The through-holes 501 have a circular shape in a plan view of the second mask 500 and the resin 40A, which is dispersed from above the through-holes 501, is deposited in a circular shape on the first deposit W1A.

Through the first step and second step, the first deposit W1A and the second deposit W2A are deposited, and one circular deposit WA is formed in a plan view.

By forming this deposit WA in the same manner as in the first embodiment, the speaker diaphragm 2A shown in FIG. 10 is obtained.

According to the present embodiment, it is possible to obtain the speaker diaphragm 2A provided with the cone 3A and the edge portion 4A having a difference in rigidity by the simple method of selecting the conditions of the first material 30A and the resin 40A and the deposition positions of the first material 30A and the resin 40A.

Third Embodiment

Figure 11:
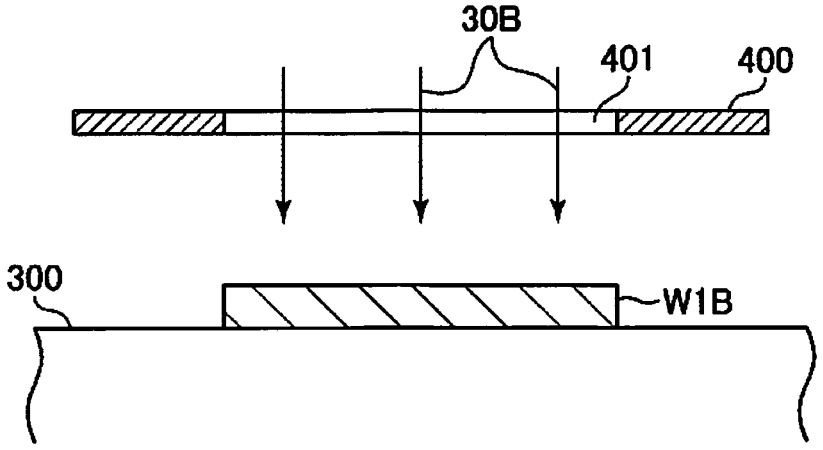
FIG. 11 is a cross-sectional view for illustrating a method for manufacturing a speaker diaphragm according to a third embodiment of the present disclosure, which shows a step of obtaining a first deposit.
Figure 12:
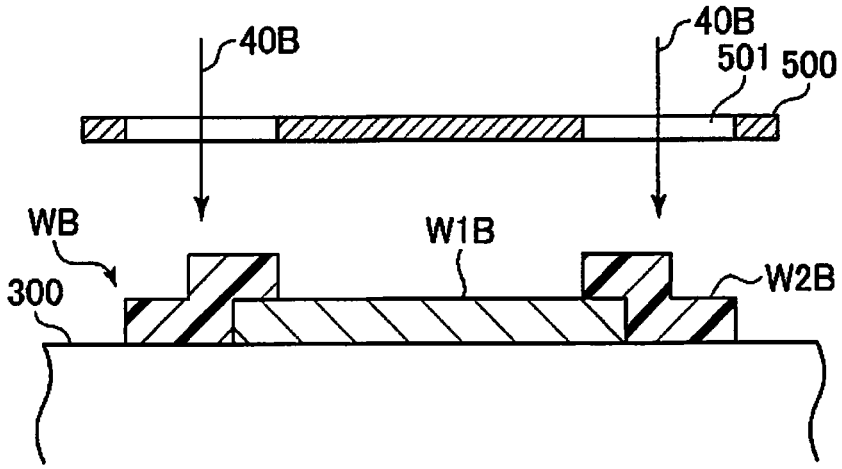
FIG. 12 is a cross-sectional view for illustrating the method for manufacturing a speaker diaphragm according to the third embodiment of the present disclosure, which shows a step of obtaining a step of obtaining a second deposit.
Figure 13:
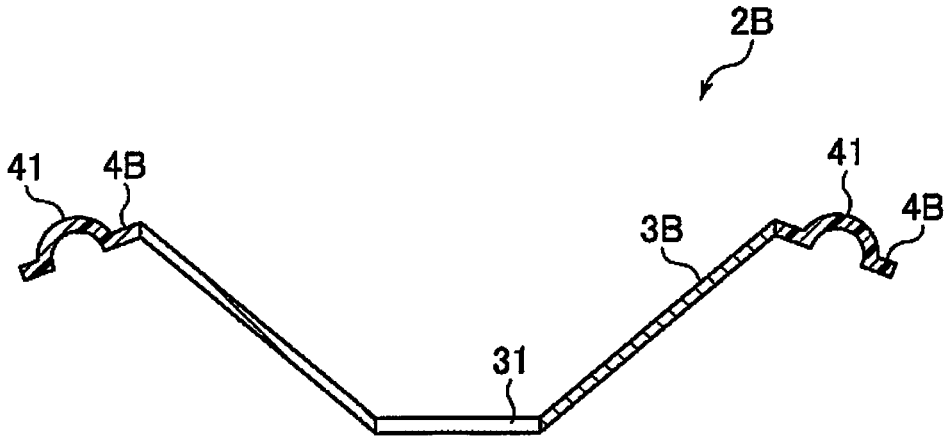
FIG. 13 is a cross-sectional view of a speaker diaphragm formed of the deposits obtained through the steps shown in FIG. 11 and FIG. 12.

FIG. 11 is a cross-sectional view for illustrating a method for manufacturing a speaker diaphragm according to the third embodiment of the present disclosure, which shows a step of obtaining a first deposit. FIG. 12 is a cross-sectional view for illustrating the method for manufacturing a speaker diaphragm according to the third embodiment of the present disclosure, which shows a step of obtaining a step of obtaining a second deposit. FIG. 13 is a cross-sectional view of a speaker diaphragm formed of the deposits obtained through the steps shown in FIG. 11 and FIG. 12.

A description will be given below of the third embodiment with reference to these drawings, but explanation will be given focusing mainly on differences from the first embodiment described above and explanation of the points of similarity will be omitted.

A speaker diaphragm 2B of the present embodiment is the same as the first embodiment except that the configuration of the speaker diaphragm 2B and the manufacturing method thereof are different.

In the speaker diaphragm 2B shown in FIG. 13, a first material 30B of a cone 3B and a second material 40B of an edge portion 4B are different. Specifically, the first material 30B includes the first fibers and the first resin, and the second material 40B does not include the fibers, but is formed only of the resin.

That is, in the present embodiment, the content of fibers in the first material 30B is greater than the content of fibers of in the second material 40B, and the content of resin in the first material 30B is less than the content of resin in the second material 40B.

Such a configuration makes the edge portion 4B more flexible than the cone 3B. Therefore, it is possible to obtain the same effect as that of the first embodiment and to obtain the speaker diaphragm 2B by a simple method of selecting the conditions of the second resin.

In addition, the first resin and the second resin may have the same composition or different compositions, but the second resin preferably has a higher elastic modulus than the first resin.

Next, a description will be given of a method for manufacturing the speaker diaphragm 2B.

As shown in FIG. 11, the first material 30B in which cotton-like fibers and a granular resin are mixed is deposited on the mounting table 300 to obtain a first deposit W1B (first deposition step).

This step is performed using the first mask 400 having the through-holes 401. The through-holes 401 have a circular shape in a plan view of the first mask 400 and the first material 30B, which is dispersed from above the through-holes 401, is deposited in a circular shape on the mounting table 300.

The first material 30B is obtained in the same manner as the first material 30 of the first embodiment.

Next, as shown in FIG. 12, a resin 40B is deposited on the first deposit W1B and across the edge portion of the first deposit W1B and the mounting table 300 and the second deposit W2B is obtained (second step). That is, in the present embodiment, in the deposit WB, an overlapping portion in which the first deposit W1B and the second deposit W2B overlap is formed.

The form of the resin 40B may be, for example, a solid which is granular, fibrous, or the like, or may be a liquid; however, in the case of a liquid, the viscosity is preferably relatively high.

This step is performed using the second mask 500 having the through-holes 501. The through-holes 501 have a circular shape in a plan view of the second mask 500 and the resin 40B, which is dispersed from above the through-holes 501, is deposited in a circular shape on the mounting table 300.

Through the first step and second step, the deposit WB is formed.

By forming the deposit WB in the same manner as in the first embodiment, the speaker diaphragm 2B shown in FIG. 13 is obtained.

According to the present embodiment, the speaker diaphragm 2B provided with the cone 3B and the edge portion 4B having a difference in rigidity is obtained by the simple method of selecting the conditions of the first material 30B and the resin 40B and the deposition positions of the first material 30B and the resin 40B.

In particular, in the present embodiment, the rigidity at the boundary portion between the cone 3B and the edge portion 4B is lower than the rigidity of the cone 3B and higher than the rigidity of the edge portion 4B. Therefore, a configuration is adopted in which abrupt changes in the rigidity are prevented at the boundary portion between the cone 3B and the edge portion 4B. Therefore, stress due to vibrations is relieved at the boundary portion, it is possible to exhibit superior acoustic characteristics, and the durability is also excellent.

Fourth Embodiment

Figure 14:
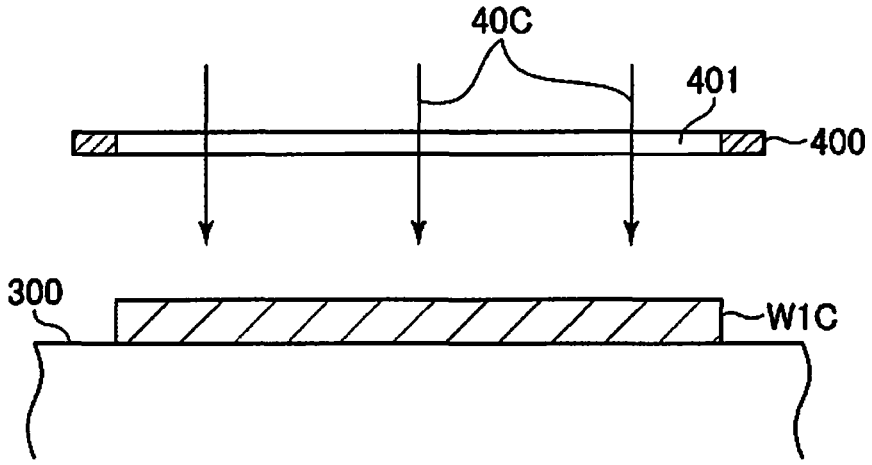
FIG. 14 is a cross-sectional view for illustrating a method for manufacturing a speaker diaphragm according to a fourth embodiment of the present disclosure, which shows a step of obtaining a first deposit.
Figure 15:
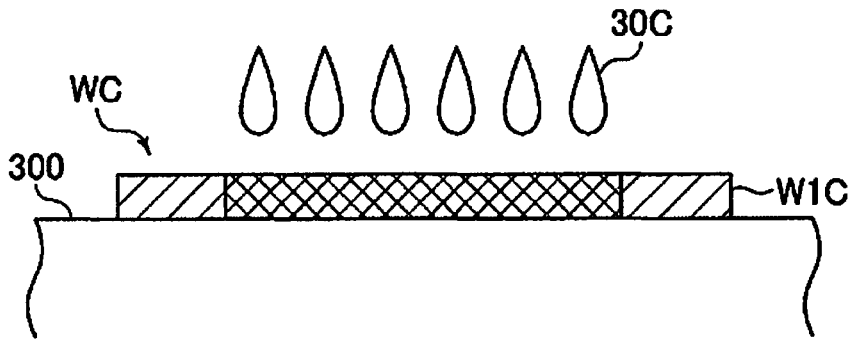
FIG. 15 is a cross-sectional view for illustrating the method for manufacturing a speaker diaphragm according to a fourth embodiment of the present disclosure, which shows a step of supplying a resin to the first deposit.
Figure 16:
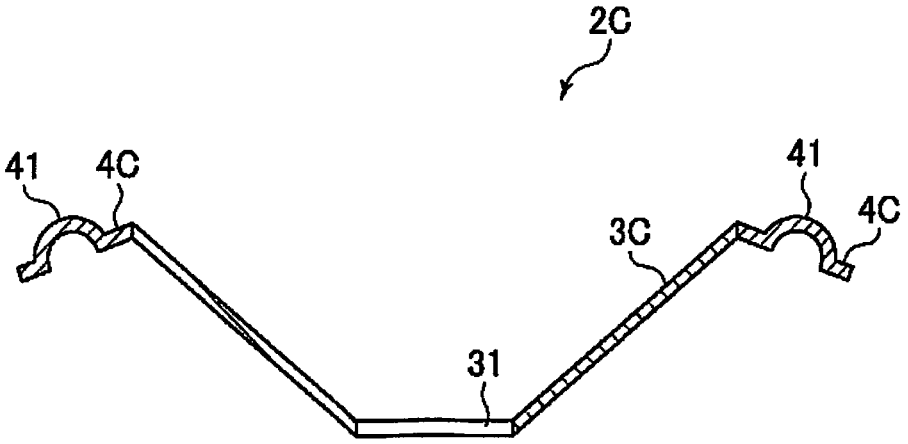
FIG. 16 is a cross-sectional view of a speaker diaphragm formed of the deposit obtained through the steps shown in FIG. 14 and FIG. 15.

FIG. 14 is a cross-sectional view for illustrating a method for manufacturing a speaker diaphragm according to a fourth embodiment of the present disclosure, which shows a step of obtaining a first deposit. FIG. 15 is a cross-sectional view for illustrating the method for manufacturing a speaker diaphragm according to the fourth embodiment of the present disclosure, which shows a step of supplying a resin to the first deposit. FIG. 16 is a cross-sectional view of a speaker diaphragm formed of the deposit obtained through the steps shown in FIG. 14 and FIG. 15.

A description will be given below of the fourth embodiment with reference to these drawings, but explanation will be given focusing mainly on differences from the first embodiment described above and explanation of the points of similarity will be omitted.

A speaker diaphragm 2C of the present embodiment is the same as in the first embodiment except that the configuration of the speaker diaphragm 2C and the manufacturing method thereof are different.

In the speaker diaphragm 2C shown in FIG. 16, the first material of a cone 3C and the second material of an edge portion 4C are different. Specifically, in the first material and the second material, the conditions of the first fibers and the second fibers, that is, the content, the composition, and the average fiber length and width are the same, but the conditions of the first resin and the second resin, that is, the composition and the content are different. The first resin includes a resin of the same type as the second resin and a resin with a higher rigidity than the second resin. Due to this, the cone 3C has higher rigidity than the edge portion 4C. Therefore, it is possible to obtain an effect similar to each embodiment above and to obtain the speaker diaphragm 2C by the simple method of selecting the conditions of first resin.

The content of the first resin in the first material is not particularly limited, but is preferably 15% by weight or more and 65% by weight or less, and more preferably 18% by weight or more and 55% by weight or less. With such a content, it is possible to obtain the cone 3C in which the first fibers are sufficiently bound, the moldability is also good, and which is lightweight and has a necessary and sufficient rigidity.

Next, a description will be given of a method for manufacturing the speaker diaphragm 2C.

As shown in FIG. 14, a mixture 40C of cotton-like fibers and a granular resin is deposited on the mounting table 300 to obtain a first deposit W1C (deposition step).

This step is performed using the first mask 400 having the through-holes 401. The through-holes 401 have a circular shape in a plan view of the first mask 400 and the mixture 40C, which is dispersed from above the through-holes 401, is deposited in a circular shape on the mounting table 300.

The mixture 40C is obtained in the same manner as the first material 30 of the above embodiment.

Next, as shown in FIG. 15, a resin 30C is supplied to the portion of the first deposit W1C excluding the edge portion (resin supply step). In the present embodiment, the resin 30C is preferably in a liquid state. Due to this, the resin 30C is impregnated into the first deposit W1C and the fibers and the resin are further mixed in the obtained cone 3C in a favorable and uniform manner.

In the illustrated configuration, the use of a mask is omitted, but, for example, a mask as shown in FIG. 12 may be used.

Through the first step and the second step, a deposit WC is formed in which the resin 30C is impregnated in a portion of the first deposit W1C excluding the edge portion.

By forming this deposit WC in the same manner as in the first embodiment, the speaker diaphragm 2C shown in FIG. 16 is obtained.

According to the present embodiment, it is possible to obtain the speaker diaphragm 2C provided with the cone 3C and the edge portion 4C having a difference in rigidity by a simple method of selecting the conditions of the mixture 40C and the resin 30C and the deposition positions of the mixture 40C and the resin 30C.

Fifth Embodiment

Figure 17:
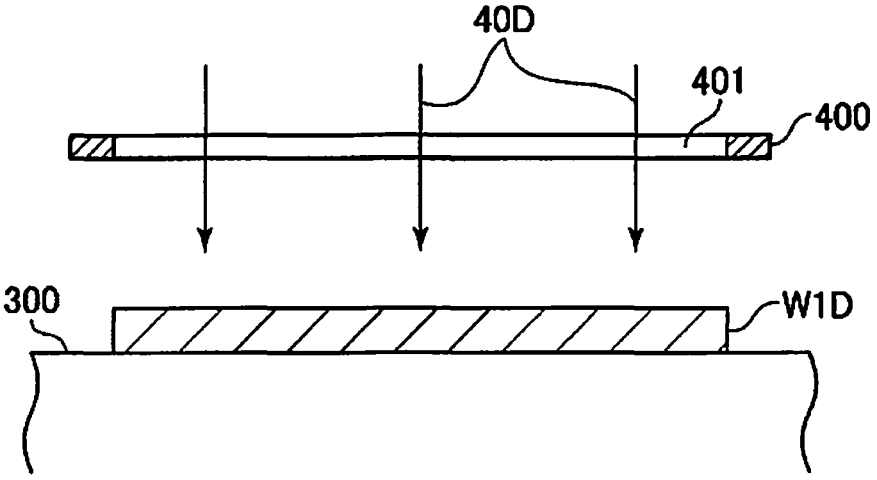
FIG. 17 is a cross-sectional view for illustrating a method for manufacturing a speaker diaphragm according to a fifth embodiment of the present disclosure, which shows a step of obtaining a first deposit.
Figure 18:
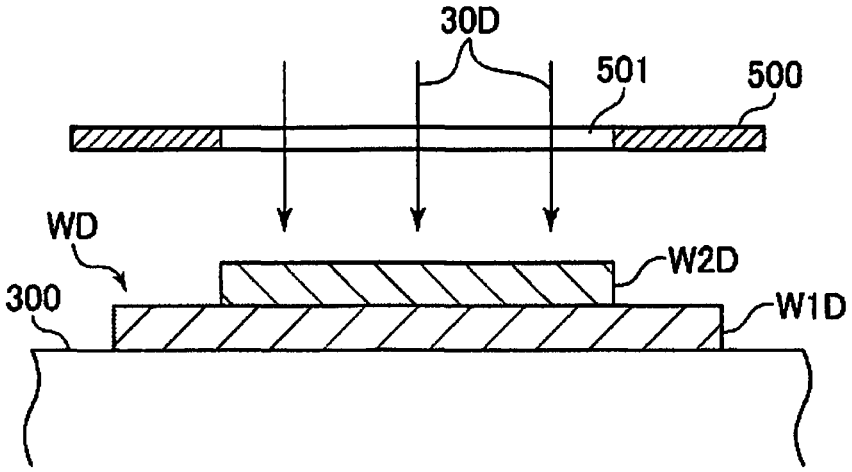
FIG. 18 is a cross-sectional view for illustrating the method for manufacturing a speaker diaphragm according to the fifth embodiment of the present disclosure, which shows a step of laminating a second deposit on the first deposit.
Figure 19:
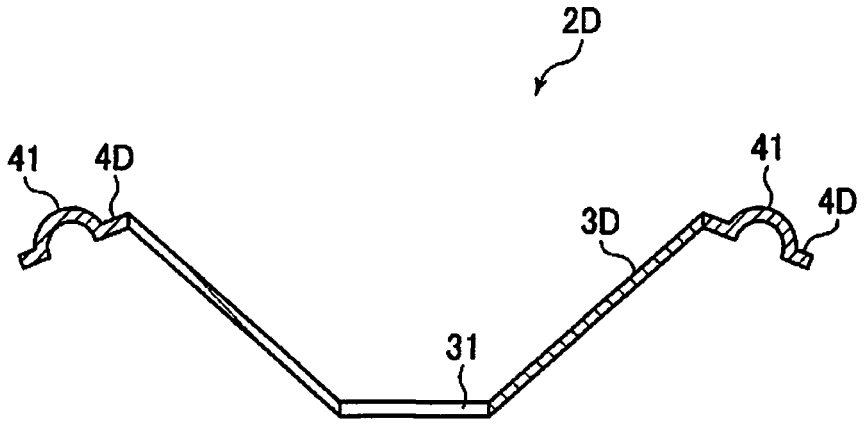
FIG. 19 is a cross-sectional view of a speaker diaphragm formed of the deposits obtained through the steps shown in FIG. 17 and FIG. 18.

FIG. 17 is a cross-sectional view for illustrating the method for manufacturing a speaker diaphragm according to the fifth embodiment of the present disclosure, which shows a step of obtaining a first deposit. FIG. 18 is a cross-sectional view for illustrating the method for manufacturing a speaker diaphragm according to the fifth embodiment of the present disclosure, which shows a step of laminating the second deposit on the first deposit. FIG. 19 is a cross-sectional view of a speaker diaphragm formed of the deposits obtained through the steps shown in FIG. 17 and FIG. 18.

A description will be given below of the fifth embodiment with reference to these drawings, but explanation will be given focusing mainly on differences from the first embodiment described above and explanation of the points of similarity will be omitted.

A speaker diaphragm 2D of the present embodiment is the same as the first embodiment except that the configuration of the speaker diaphragm 2D and the manufacturing method thereof are different.

In the speaker diaphragm 2D shown in FIG. 19, a cone 3D has a two-layer configuration, and an edge portion 4D has a single-layer configuration. That is, the number of laminated layers differs between the cone 3D and the edge portion 4D, and the number of laminated layers is smaller at the edge portion 4D than the cone 3D. Due to this, it is possible to realize a difference in rigidity between the cone 3 and the edge portion 4.

When at least one of the cone 3D and the edge portion 4D is configured by a laminate in which a plurality of laminated layers are laminated, it is possible to obtain the same effect as each of the embodiments above.

In addition, each layer of the cone 3D is formed of a material including fibers and a resin, and the fibers and resin of each layer may have the same conditions, or may differ. In addition, each layer may be formed to include only one of fibers and resin.

Next, a description will be given of a method for manufacturing the speaker diaphragm 2D.

As shown in FIG. 17, a mixture 40D of cotton-like fibers and a granular resin is deposited on the mounting table 300 to obtain a first deposit W1D (first step).

This step is performed using the first mask 400 having the through-holes 401. The through-holes 401 have a circular shape in a plan view of the first mask 400 and the mixture 40D, which is dispersed from above the through-holes 401, is deposited in a circular shape on the mounting table 300.

The mixture 40D is obtained in the same manner as the first material 30 of the above embodiments.

Next, as shown in FIG. 18, a mixture 30D of cotton-like fibers and a granular resin is deposited on the first deposit W1D and on the portion excluding the edge portion of the first deposit W1D, and the second deposit W2D is laminated (second step).

This step is performed using the second mask 500 having the through-holes 501. The through-holes 501 have a circular shape in a plan view of the second mask 500 and has a diameter smaller than that of the through-hole 401 of the first mask 400.

Through the first step and the second step, a deposit WD (laminate) is obtained.

By forming this deposit WD in the same manner as in the first embodiment, it is possible to obtain the speaker diaphragm 2D shown in FIG. 19.

According to the present embodiment, the speaker diaphragm 2D provided with the cone 3D and the edge portion 4D having different rigidity is obtained by a simple method of selecting the conditions of the mixture 30D and the mixture 40D and the deposition positions of the mixture 30D and the mixture 40D.

In the speaker diaphragm 2D, the thicknesses of the cone 3D and the edge portion 4D are constant, and the bulk density of the second material which is a constituent material of the edge portion 4D is lower than the bulk density of the first material which is a constituent material of the cone 3D. Due to this, it is possible to realize a difference in rigidity between the cone 3D and the edge portion 4D in the same manner as in each of the embodiments and it is possible to obtain the effect of the present disclosure. In addition, even if the constituent materials of the first deposit W1D and the second deposit W2D are the same, it is possible to obtain the effect of the present disclosure.

Sixth Embodiment

Figure 20:
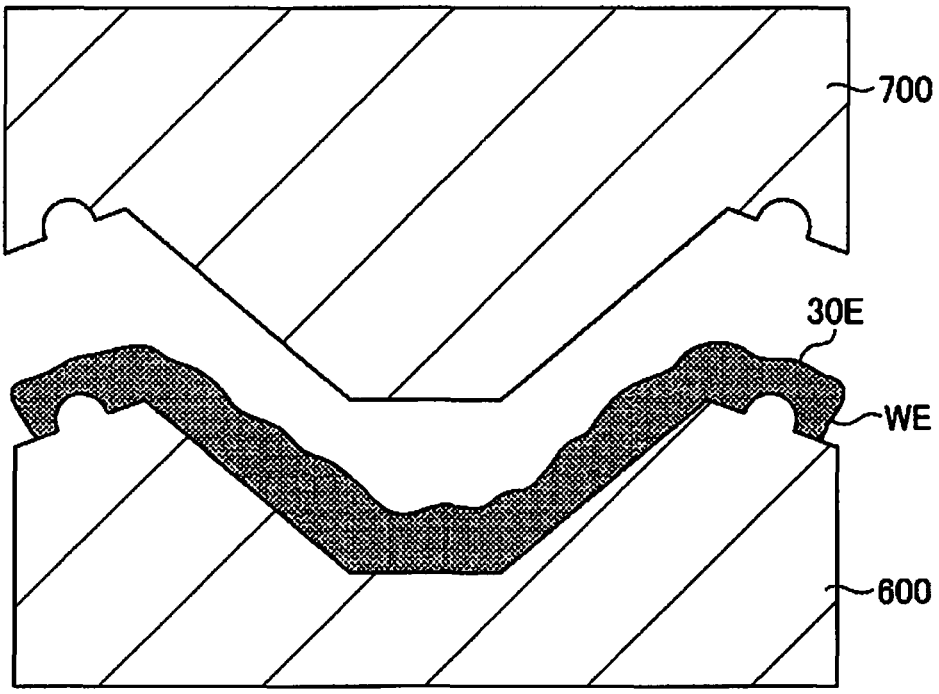
FIG. 20 is a cross-sectional view for illustrating a method for manufacturing a speaker diaphragm according to a sixth embodiment of the present disclosure, which shows a state in which a deposit is formed.
Figure 21:
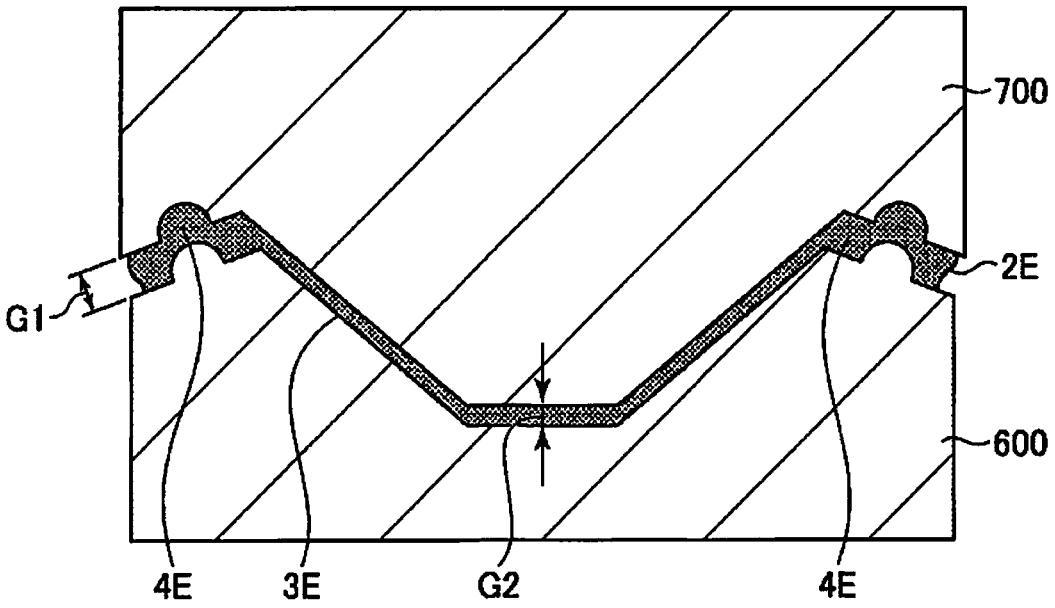
FIG. 21 is a cross-sectional view for illustrating the method for manufacturing a speaker diaphragm according to the sixth embodiment of the present disclosure, which shows a state in which the deposit is heated and pressed.

FIG. 20 is a cross-sectional view for illustrating a method for manufacturing a speaker diaphragm according to the sixth embodiment of the present disclosure, which shows a state in which a deposit is formed. FIG. 21 is a cross-sectional view for illustrating the method for manufacturing a speaker diaphragm according to the sixth embodiment of the present disclosure, which shows a state in which the deposit is heated and pressed.

A description will be given below of the sixth embodiment with reference to these drawings, but explanation will be given focusing mainly on differences from the first embodiment described above and explanation of the points of similarity will be omitted.

A speaker diaphragm 2E of the present embodiment is the same as the first embodiment except that the configuration of the speaker diaphragm 2E and the manufacturing method thereof are different.

First, a description will be given of a lower mold 600 and an upper mold 700 used in the method for manufacturing the speaker diaphragm 2E.

As shown in FIG. 20 and FIG. 21, in the present embodiment, the lower mold 600 and the upper mold 700 are used. The lower mold 600 is formed with a concave cavity corresponding to the cone shape of the speaker diaphragm 2E to be manufactured and the upper mold 700 is formed with a convex shape corresponding to the cavity.

In addition, as shown in FIG. 21, when the concave and convex parts of the lower mold 600 and the upper mold 700 are combined, a separation distance G1 of the portion forming an edge portion 4E in the lower mold 600 and the upper mold 700 is larger than a separation distance G2 of a portion forming a cone 3E.

Next, a description will be given of a method for manufacturing the speaker diaphragm 2E.

First, as shown in FIG. 20, a mixture 30E of cotton-like fibers and a granular resin is deposited on the surface including the inner peripheral surface of the cavity of the lower mold 600 to obtain a deposit WE (first step). In this step, the mixture 30E is deposited such that the thickness is as uniform as possible.

Next, as shown in FIG. 21, the lower mold 600 and the upper mold 700 are brought close to each other to press the deposit WE so as to form the speaker diaphragm 2E. At this time, since the separation distance G1 is larger than the separation distance G2 as described above, the degree of pressure is different between the cone 3E and the edge portion 4E, and the pressure on the edge portion 4E is weaker than pressure on the cone 3E. Due to this, the thickness of the edge portion 4E is thicker than the thickness of the cone 3E, but the bulk density of the second material of the edge portion 4E is lower than the bulk density of the first material of the cone 3E.

According to the speaker diaphragm 2E, it is possible to realize a difference in rigidity between the cone 3E and the edge portion 4E in the same manner as in each of the embodiments above and it is possible to obtain the effect of the present disclosure. In addition, even if the same material is supplied to the cone 3E and the edge portion 4E, that is, even if the first material and the second material are the same, it is possible to obtain the effect of the present disclosure. The lower mold 600 and the upper mold 700 preferably have a heating function.

Seventh Embodiment

Figure 22:
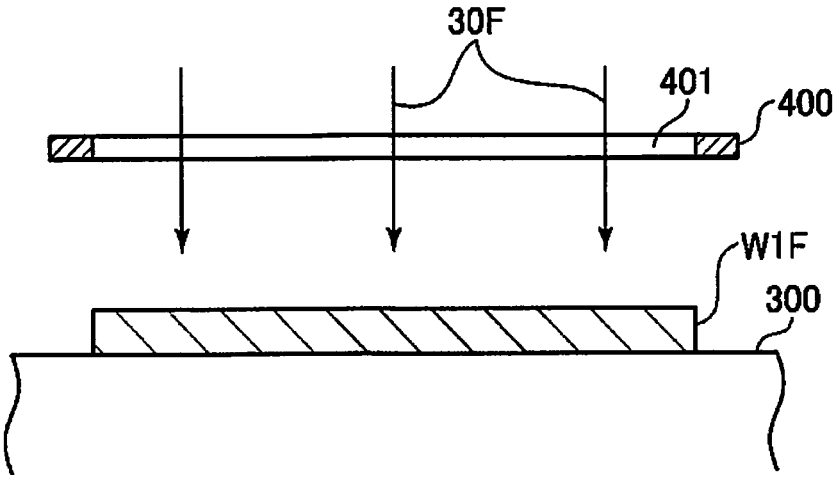
FIG. 22 is a cross-sectional view for illustrating a method for manufacturing a speaker diaphragm according to a seventh embodiment of the present disclosure, which shows a state in which a deposit is formed.
Figure 23:
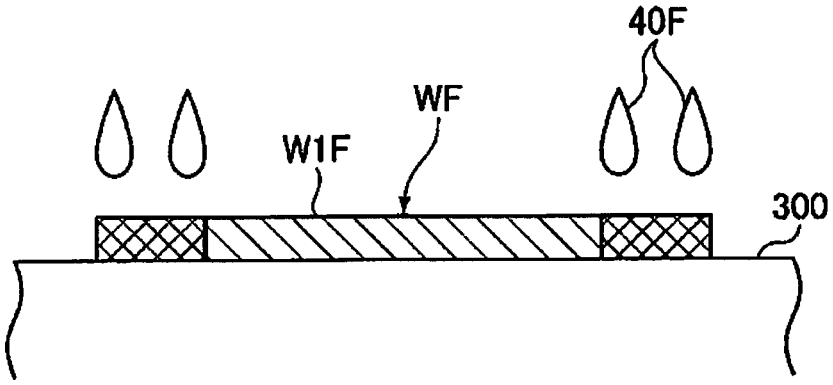
FIG. 23 is a cross-sectional view for illustrating the method for manufacturing a speaker diaphragm according to the seventh embodiment of the present disclosure, which shows a state in which a resin is impregnated in the deposit.
Figure 24:
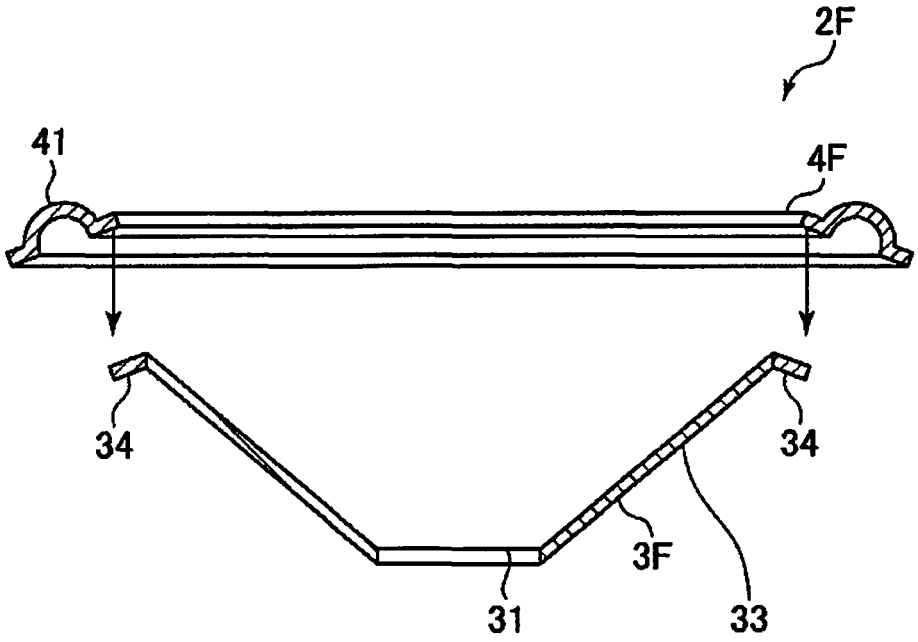
FIG. 24 is a cross-sectional view for illustrating the method for manufacturing a speaker diaphragm according to the seventh embodiment of the present disclosure, which shows a state in which an edge portion is bonded to an edge portion bonding site.

FIG. 22 is a cross-sectional view for illustrating a method for manufacturing a speaker diaphragm according to the seventh embodiment of the present disclosure, which shows a state in which a deposit is formed. FIG. 23 is a cross-sectional view for illustrating the method for manufacturing a speaker diaphragm according to the seventh embodiment of the present disclosure, which shows a state in which a resin is impregnated in the deposit. FIG. 24 is a cross-sectional view for illustrating the method for manufacturing a speaker diaphragm according to the seventh embodiment of the present disclosure, which shows a state in which an edge portion is bonded to an edge portion bonding site.

A description will be given below of the seventh embodiment with reference to these drawings, but explanation will be given focusing mainly on differences from the first embodiment described above and explanation of the points of similarity will be omitted.

A speaker diaphragm 2F of the present embodiment is the same as the first embodiment except that the configuration of the speaker diaphragm 2F and the manufacturing method thereof are different.

As shown in FIG. 24, the speaker diaphragm 2F has a cone 3F and an edge portion 4F. In addition, the cone 3F has a cone-shaped main body 33 in which the opening 31 is formed, and an edge portion bonding site 34 positioned on an outer peripheral portion of the main body 33.

The edge portion bonding site 34 has a flange shape integrally formed on an edge portion positioned on the outer periphery of the main body 33. The edge portion bonding site 34 is a portion to be bonded to the edge portion 4F via an adhesive.

The main body 33 is formed of a first material and the edge portion bonding site 34 is formed of a second material.

The first material is formed to include first fibers and a first resin and the second material is formed to include second fibers and a second resin.

For the first material and the second material, the conditions of the first fibers and the second fibers, that is, the content, the composition, and the average fiber length and width are the same, but the conditions of the first resin and the second resin, that is, the composition and content are different. The second resin includes a resin having the same conditions as the first resin, and a resin having a relatively high affinity to the adhesive.

The resin having a relatively high affinity is not particularly limited, but examples thereof include polyolefin-based, polyester-based, polyamide-based, polyacetal, polycarbonate, modified polyphenylene ether, cyclic polyolefin, ABS resin, polystyrene, polyvinyl chloride, polyvinyl acetate, polyurethane, Teflon (registered trademark), acrylic resin, polyphenylene sulfide, polytetrafluoroethylene, polysulfone, polyether sulfone, amorphous polyaryate, liquid crystal polymer, polyether ether ketone, thermoplastic polyimide, polyamide imide, petroleum-derived resins such as phenol resin, epoxy resin, vinyl ester resin, and unsaturated polyester, or biomass plastics and biodegradable plastics such as polylactic acid, polycaprolactone, modified starch, polyhydroxybutyrate, polybutylene succinate, and polybutylene succinate adipate.

In addition, the content of the second resin in the second material is larger than the content of the first resin in the first material. Due to this, even if the first resin and the second resin have the same conditions, it is possible to increase the bonding strength (adhesive strength) between the edge portion bonding site 34 and the edge portion 4F by increasing the ratio of the resin.

The content of the resin having a relatively high affinity to the adhesive in the second resin is not particularly limited, but is preferably 15% by weight or more and 50% by weight or less, and more preferably 18% by weight or more and 40% by weight or less. With such a content, it is possible to more reliably increase the bonding strength (adhesive strength) between the edge portion bonding site 34 and the edge portion 4F by increasing the ratio of the resin having a relatively high affinity.

As described above, the speaker diaphragm 2F is provided with the cone 3F having the main body 33 formed of the first material including the first fibers derived from a plant and the first resin which binds the first fibers together, and the edge portion bonding site 34 positioned at the outer peripheral portion of the main body 33 and formed of a second material including a second resin and to which the edge portion 4F is bonded, and, additionally, the content of the second resin in the second material is greater than the content of the first resin in the first material.

Due to this, it is possible to increase the adhesion between the adhesive and the edge portion bonding site 34 by increasing the ratio of the resin of the edge portion bonding site 34, thus, it is possible to increase the bonding strength (adhesive strength) between the edge portion bonding site 34 and the edge portion 4F. In addition, since the bonding strength is increased, it is possible to reduce the amount of the adhesive and to suppress the occurrence of thickness unevenness of the adhesive as in the related art. As a result, it is possible to suppress deterioration of the acoustic characteristics. For such an effect, there are few individual differences at the time of manufacturing a plurality of the speakers 1.

In addition, the speaker diaphragm 2F has the edge portion 4F bonded to the edge portion bonding site 34. As described in the above embodiment, since the edge portion 4F is also formed of a material including fibers and a resin, it is possible to increase the adhesion between the adhesive and the edge portion. As a result, it is possible to further reduce the amount of the adhesive and to further suppress defects caused by the thickness unevenness of the adhesive.

Next, a description will be given of a method for manufacturing the speaker diaphragm 2F.

First, as shown in FIG. 22, a first material 30F in which cotton-like fibers and a granular resin are mixed is deposited on the mounting table 300 to obtain a first deposit W1F (first deposition step).

This step is performed using the first mask 400 having the through-holes 401. The through-holes 401 have a circular shape in a plan view of the first mask 400 and the first material 30F, which is dispersed from above the through-holes 401, is deposited in a circular shape on the mounting table 300.

The first material 30F is in a state in which the first fibers and the granular first resin are mixed and is able to be obtained in the same manner as the first material 30 of the first embodiment.

Next, as shown in FIG. 23, a resin 40F is supplied on the first deposit W1F and at the edge portion of the first deposit W1F.

The form of the resin 40F may be, for example, a solid which is granular, fibrous, or the like, or may be a liquid; however, in the case of a liquid, the viscosity is preferably relatively high.

This step is performed using the second mask 500 having the through-holes 501. The through-holes 501 have a circular shape in a plan view of the second mask 500 and the resin 40F, which is dispersed from above the through-holes 501, is deposited in a circular shape on the mounting table 300.

Through the first step and second step, a deposit WF is formed.

By forming this deposit WF in the same manner as in the first embodiment, the speaker diaphragm 2F shown in FIG. 24 is obtained.

In particular, in the present embodiment, the rigidity at the boundary portion between the cone 3F and the edge portion 4F is lower than that of the cone 3F and higher than that of the edge portion 4F. Therefore, a configuration is adopted in which abrupt changes in the rigidity are prevented at the boundary portion between the cone 3F and the edge portion 4F. Therefore, the stress due to the vibration is relieved at the boundary portion, it is possible to exhibit superior acoustic characteristics, and the durability is also excellent.

Although the speaker diaphragm and the speaker unit of the present disclosure were described above based on each illustrated embodiment, the present disclosure is not limited thereto and it is possible to replace each portion forming the speaker diaphragm and the speaker unit with any configuration capable of exhibiting the same function. In addition, any component may be added thereto.

In addition, the speaker diaphragm and the speaker unit may combine any two or more configurations (features) of the above-described embodiments.

Eighth Embodiment

1. Speaker Configuration

Figure 25:
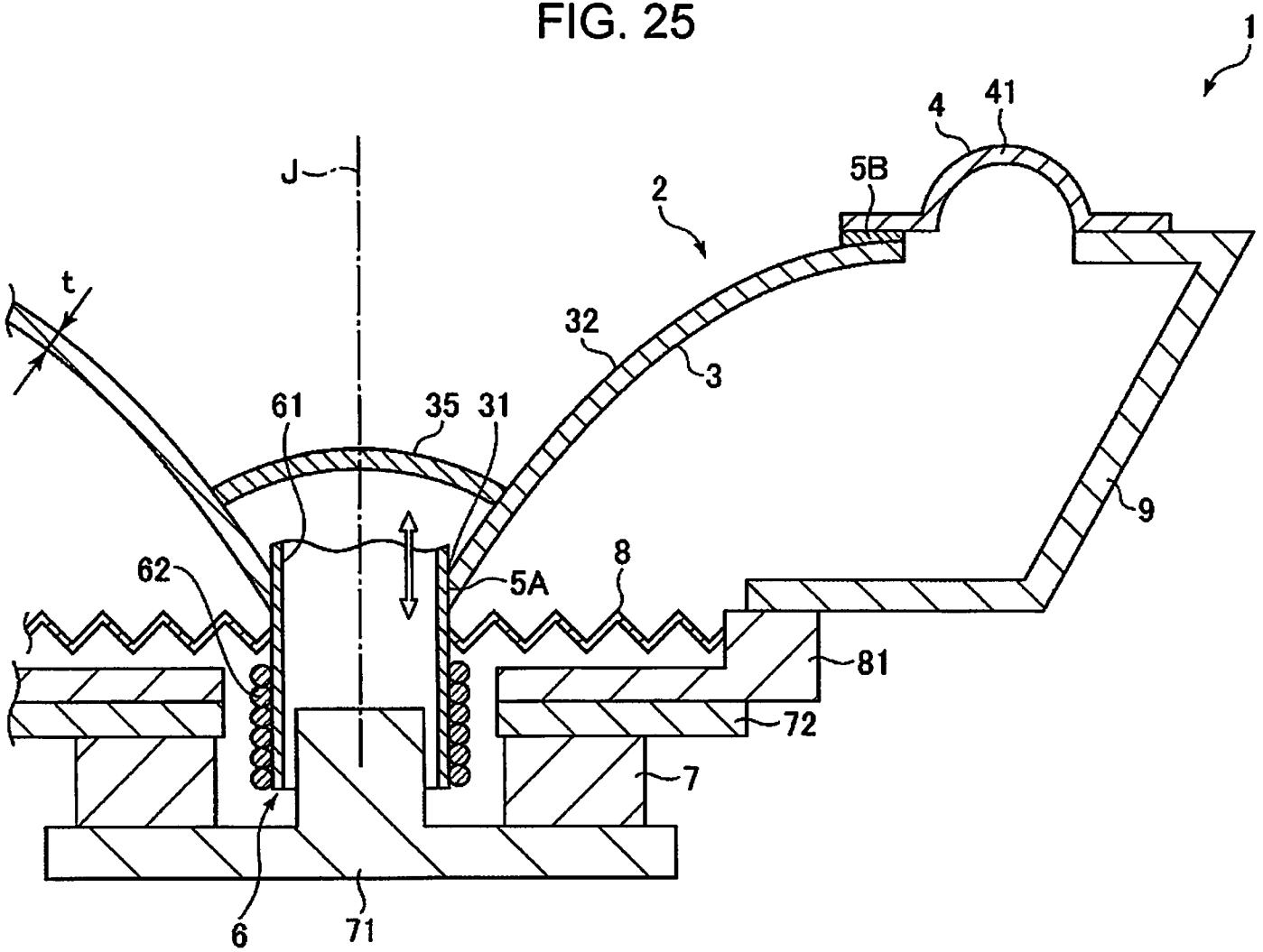
FIG. 25 is a longitudinal cross-sectional view which shows an eighth embodiment of the speaker of the present disclosure.
Figure 26:
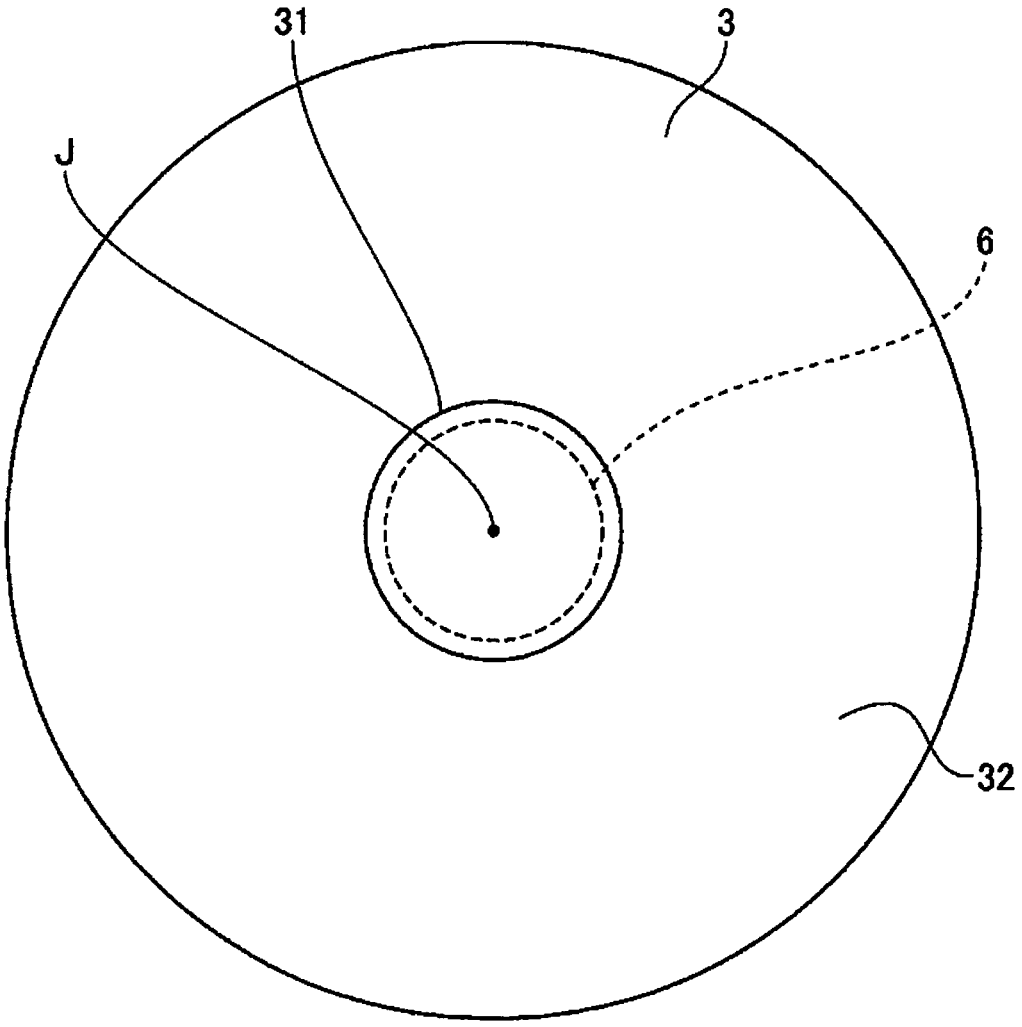
FIG. 26 is a plan view of a cone-shaped speaker diaphragm shown in FIG. 25.
Figure 27:
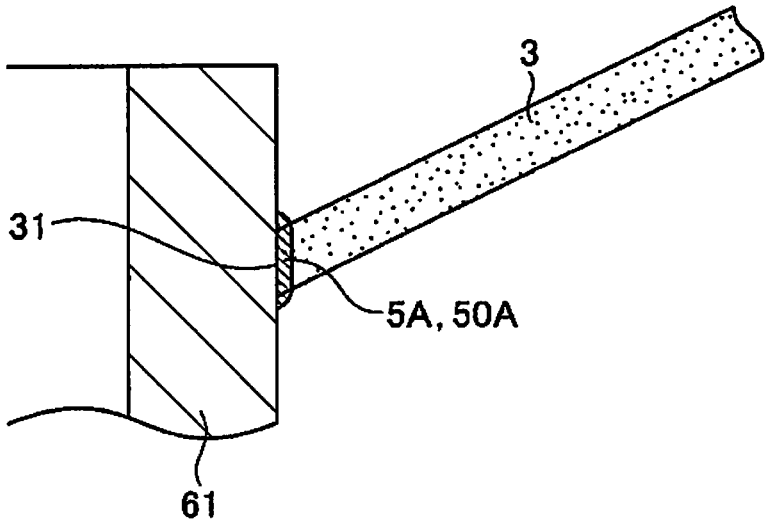
FIG. 27 is a longitudinal cross-sectional view which shows an adhesion portion between an inner peripheral portion of the speaker diaphragm and a voice coil bobbin shown in FIG. 25.
Figure 28:
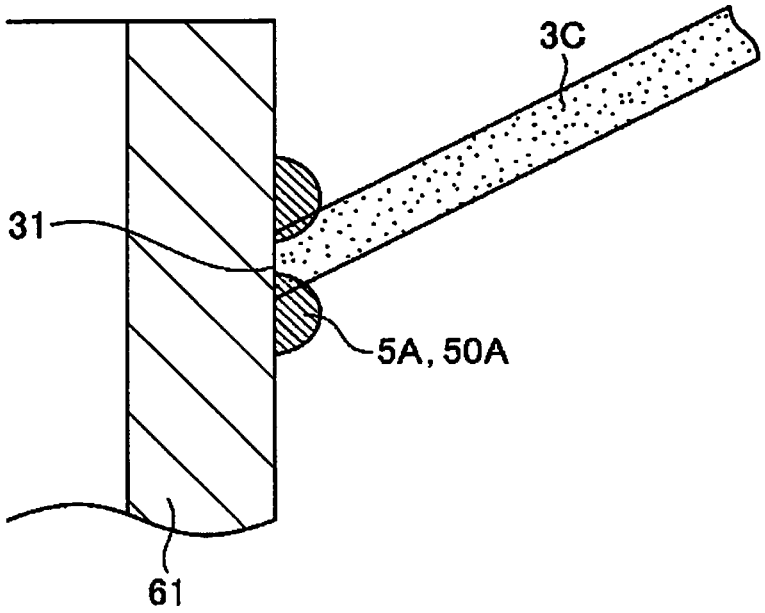
FIG. 28 is a longitudinal cross-sectional view which shows an adhesion portion between an inner peripheral portion of a speaker diaphragm and a voice coil bobbin of the related art.

FIG. 25 is a longitudinal cross-sectional view which shows the eighth embodiment of the speaker of the present disclosure. FIG. 26 is a plan view of the cone-shaped speaker diaphragm shown in FIG. 25. FIG. 27 is a longitudinal cross-sectional view which shows an adhesion portion between an inner peripheral portion of the speaker diaphragm shown in FIG. 25 and the voice coil bobbin. FIG. 28 is a longitudinal cross-sectional view which shows the inner peripheral portion of the speaker diaphragm of the related art and the adhesion portion of the voice coil bobbin. Below, for convenience of explanation, the upper side of FIG. 25, FIG. 26, FIGS. 27, and 28 is referred to as "top" or "upper" and the lower side as "bottom" or "lower".

As shown in FIG. 25, the speaker 1 of the present disclosure is provided with the speaker diaphragm 2, the vibrator 6, the permanent magnet 7, the yoke 71, the top plate 72, the damper 8, the ring member 81, and the frame 9.

Applications for the speaker diaphragm 2 and the speaker 1 provided therewith are not particularly limited, and examples thereof include woofers, tweeters, and full range speakers.

The speaker diaphragm 2 has a cone 3 and an edge 4 bonded to the outer peripheral portion of the cone 3 via an adhesive 5B. The overall shape of the cone 3 is a shape of rotating body with respect to the central axis J, and, in particular, a substantially truncated cone shape. Here, the central upper surface, that is, the inner surface in FIG. 25 of the cone 3 forms a sound wave emitting surface 32, and, as the sound wave emitting surface 32 goes upward, the distance from the central axis J gradually increases. In addition, as the sound wave emitting surface 32 goes upward, the angle with respect to the central axis J gradually increases. As shown in FIG. 25 and FIG. 26, the circular opening 31 into which the voice coil bobbin 61 is inserted is formed at the lower portion, that is, the central portion, of the cone 3. The shape of the cone 3 having the sound wave emitting surface 32 and the opening 31 as described above is referred to below as a "cone shape". In addition, the cone shape in the state in which the opening 31 is not yet formed is referred to as a "cone shape without an opening."

The shape of the sound wave emitting surface 32 is not limited to the illustrated shape and may be a shape which has, for example, a stepped portion or a wave shape in a longitudinal end view.

The outer diameter of the cone 3 is not particularly limited, but is preferably 10 mm or more and 800 mm or less, and more preferably 15 mm or more and 600 mm or less.

The inner diameter (diameter of the opening 31) of the cone 3 is not particularly limited, but is preferably 3 mm or more and 200 mm or less, and more preferably 5 mm or more and 150 mm or less.

The edge 4 has a circular shape centering on the central axis J, and the inner peripheral portion thereof is adhered and fixed via the adhesive 5B to the outer peripheral portion of the cone 3. In addition, the edge 4 has the curved convex portion 41 which protrudes upward in the longitudinal end view of FIG. 25. The curved convex portion 41 is deformed along with the vibration of the cone 3. The edge portion 4 is formed of a material having flexibility, plasticity, or elasticity. The constituent material of the edge 4 may be the same as or different from the constituent material of the cone 3 described below.

The outer peripheral portion of the edge portion 4 is fixed to the upper portion of the frame 9 by a method such as adhesion with an adhesive or fusion, for example.

The speaker 1 is provided with the vibrator 6 having the cylindrical voice coil bobbin 61 and the voice coil 62 wound around and mounted on the outer peripheral portion of the voice coil bobbin 61. The edge portion of the opening 31 of the cone 3, that is, the inner peripheral portion of the speaker diaphragm 2 is adhered and fixed via the adhesive 5A to the outer peripheral surface of the voice coil bobbin 61 above the voice coil 62. As the adhesive 5A, it is possible to use, for example, various types of adhesive such as a thermosetting adhesive, a photocurable adhesive, and a hot melt adhesive.

The cap 35 is mounted on the lower portion on the inside of the cone 3 so as to cover the upper end opening of the voice coil bobbin 61. The outer peripheral edge of the cap 35 is fixed to the sound wave emitting surface 32 of the cone 3 by, for example, adhesion with an adhesive.

On the outer peripheral portion of the voice coil 62, the permanent magnet 7, the yoke 71 bonded to the permanent magnet 7, the top plate 72 installed on the upper portion of the permanent magnet 7, and the ring member 81 formed on the upper portion of the top plate 72 are installed without contacting the voice coil 62. The permanent magnet 7, the yoke 71, and the top plate 72 form a magnetic circuit around the voice coil 62.

When an electric signal, that is, an audio current corresponding to a sound source, is input to the voice coil 62, the vibrator 6 vibrates in the vertical direction (the central axis J direction) according to the audio current due to an electromagnetic induction action, this vibration is transmitted to the cone 3, the air in the vicinity of the sound wave emitting surface 32 of the cone 3 vibrates, and sound waves are emitted.

The ring-shaped damper 8 is installed on the outer peripheral portion of the voice coil bobbin 61. The damper 8 is flexible and has a function of damping vibration. The inner peripheral portion of the damper 8 is fixed to the outer peripheral surface of the voice coil bobbin 61 by, for example, adhesion with an adhesive, and the outer peripheral portion of the damper 8 is fixed to the ring member 81 by, for example, adhesion with an adhesive. In addition, the outer peripheral portion of the ring member 81 is fixed to the lower portion of the frame 9.

The vibrator 6 and the cone 3 bonded thereto are supported by the edge 4 and the damper 8 so as to be able to vibrate in the vertical direction with respect to the frame 9. The edge 4 and the damper 8 support the vibrator 6 and the cone 3 such that the vibrator 6 does not contact the permanent magnet 7, the top plate 72, and the like when the vibrator 6 vibrates. Due to this, it is possible for the cone 3 to vibrate smoothly and with good responsiveness with respect to the input of the audio current to the voice coil 62.

2. Constituent Material of Cone

Next, a description will be given of the constituent materials of the cone 3.

The cone 3 is formed of a material including fibers derived from a plant and a resin for binding the fibers together.

Examples of fibers derived from a plant include cellulose fiber, cotton, linter, kapok, flax, hemp, ramie, silk, and the like, it is possible to use one type or two or more types of the above in combination, and, among the above, fibers which are mainly cellulose fibers are preferable. Cellulose fibers are easy to obtain, the moldability into the cone 3 is excellent, and the obtained cone 3 has good acoustic characteristics. As the cellulose fibers, fibers derived from wood pulp are preferable. Examples of wood pulps include virgin pulp, kraft pulp, bleached chemi-thermomechanical pulp, synthetic pulp, pulp derived from used paper and recycled paper, and the like, and it is possible to use one type or two or more types of the above in combination. Here, it is sufficient if the cellulose fibers are cellulose as a compound, that is, fibers having cellulose in a narrow sense as a main component and having a fibrous form, and the cellulose fibers correspond to cellulose fibers including hemicellulose and lignin in addition to cellulose in a narrow sense.

Here, as the fibers forming the cone 3, fibers not derived from a plant may be included. Examples thereof include fibers derived from animals such as wool, resin fibers such as polyamide, tetron, rayon, cupra, acetate, vinylon, acrylic, polyethylene terephthalate, and aramid, glass fibers, carbon fibers, and the like.

The average fiber length of the fibers derived from a plant is not particularly limited, but is preferably 0.05 mm or more and 3.0 mm or less, and more preferably 0.1 mm or more and 2.5 mm or less. Due to this, binding is favorably carried out using the resin described below, the moldability is excellent, and appropriate rigidity is obtained.

The average fiber width of the fibers derived from a plant is not particularly limited, but is preferably 3 μm or more and 50 μm or less, and more preferably 5 μm or more and 40 μm or less. Due to this, binding is favorably carried out using the resin described below, the moldability is excellent, and appropriate rigidity is obtained.

In addition, for the same reason, the average aspect ratio of fibers derived from a plant, that is, the ratio of the average length to the average width is preferably 3 or more and 600 or less, and more preferably 10 or more and 400 or less.

The content of the fibers in the constituent material of the cone 3 is not particularly limited, but is preferably 20% by weight or more and 85% by weight or less, and more preferably 30% by weight or more and 70% by weight or less. With such a content, it is possible to obtain the cone 3 which is excellent in moldability into a cone shape, which is lightweight, and which has sufficient rigidity. Furthermore, when the edge portion of the opening 31 of the cone 3 is adhered to the outer peripheral surface of the voice coil bobbin 61 with the adhesive 5A, there is also an advantage in that it is possible to sufficiently preserve the impregnation property of an uncured liquid adhesive 50A and to obtain good adhesion and fixing.

In addition, in the constituent material of the cone 3, the content of the fibers derived from a plant in all of the fibers, in particular, cellulose fibers, is not particularly limited, but is preferably 60% by weight or more and 100% by weight or less, and more preferably 75% by weight or more and 100% by weight or less.

As the resin for binding fibers derived from a plant together, that is, as the binding resin, it is possible to use any thermoplastic resin or curable resin, but it is preferable to mainly use a thermoplastic resin. Examples of thermoplastic resins include AS resin, ABS resin, polyethylene, polypropylene, polyolefins such as ethylene-vinyl acetate copolymer (EVA), modified polyolefin, acrylic resin such as polymethyl methacrylate, polyvinyl chloride, polystyrene, polyesters such as polyethylene terephthalate and polybutylene terephthalate, polyamide (nylon: registered trademark) such as nylon 6, nylon 46, nylon 66, nylon 610, nylon 612, nylon 11, nylon 12, nylon 6-12, and nylon 6-66, liquid crystal polymers such as polyamideimide, polyphenylene ether, polyacetal, polyether, polyphenylene oxide, modified polyphenylene ether, polyetheretherketone, polycarbonate, polyphenylene sulfide, thermoplastic polyimide, polyetherimide and aromatic polyester, fluorine-based resins such as polytetrafluoroethylene, styrenes, polyolefins, polyvinyl chlorides, polyurethanes, polyesters, polyamides, polybutadienes, trans polyisoprenes, various thermoplastic elastomers such as fluororubbers and chlorinated polyethylenes, and it is possible to use one type or two or more types of the above in combination. Polyesters or resins including the same are particularly preferable thermoplastic resins. In addition, biomass plastic and biodegradable plastic such as polylactic acid, polycaprolactone, modified starch, polyhydroxybutyrate, polybutylene succinate, and polybutylene succinate adipate may be included. Due to this, the environmental compatibility is improved. In addition, a curable resin such as a thermosetting resin or a photocurable resin may be included. Examples of thermosetting resins include epoxy resins and phenol resins and one type or two or more types thereof may be included.

The form of the resin contained in the constituent material of the cone 3 is not particularly limited, but addition as a powder is preferable. In particular, a resin added as a powder having an average particle diameter of 0.1 μm or more and 120 μm or less is preferable and a resin added as a powder having an average particle diameter of 0.3 μm or more and 80 μm or less is more preferable. Due to this, the resin is easily dispersed uniformly with respect to the fibers and it is possible to obtain the cone 3 having no unevenness in rigidity and vibration characteristics.

The content of the resin in the constituent material of the cone 3 is not particularly limited, but is preferably 15% by weight or more and 50% by weight or less, and more preferably 18% by weight or more and 40% by weight or less. With such a content, it is possible to obtain the cone 3 in which the fibers are sufficiently bound, the moldability is good, and which is lightweight and has a necessary and sufficient rigidity. Furthermore, when the edge portion of the opening 31 of the cone 3 is adhered to the outer peripheral surface of the voice coil bobbin 61 with the adhesive 5A, there is also an advantage in that it is possible to sufficiently preserve the impregnation property of the uncured liquid adhesive 50A and to obtain good adhesion and fixing.

In the constituent material of the cone 3, the fibers are preferably randomly arranged, that is, randomly oriented. Here, random orientation is synonymous with a low degree of orientation. The reason for this will be illustrated using FIG. 3 and FIG. 4.

In the cone 3C of the related art manufactured by the wet (wet method) papermaking method, the constituent material does not include a resin and there is a tendency for the pulp fibers to orient in a certain direction. In such a case, as shown in FIG. 4, when the edge portion of the opening 31 of the cone 3C is adhered to the outer peripheral surface of the voice coil bobbin 61 with the adhesive 5A, the impregnation property of the uncured liquid adhesive 50A is poor, thus, it is necessary to apply a large amount of the adhesive 5A in order to obtain sufficient adhesive strength, and a large amount of adhesive 5A remains around the upper and lower periphery of the edge portion of the opening 31. In addition, the remaining amount of the adhesive 5A is uneven along the circumferential direction of the opening 31. Moreover, depending on the degree of this unevenness, the adhesive strength is also insufficient. In this manner, in the speaker of the related art provided with the cone 3C, the acoustic characteristics are adversely affected due to the large amount of the adhesive 5A remaining and the unevenness of the remaining amount. The individual differences at the time of manufacturing a plurality of speakers are also significant.

On the other hand, if the fibers are randomly arranged as in the cone 3, as shown in FIG. 27, when the edge portion of the opening 31 of the cone 3 is adhered to the outer peripheral surface of the voice coil bobbin 61 with the adhesive 5A, the impregnation property of the uncured liquid adhesive 50A is good, thus, it is possible to carry out uniform adhesion by applying a small amount of the adhesive 5A. Thus, the amount of the adhesive 5A remaining around the upper and lower periphery of the edge portion of the opening 31 is also small, and the remaining amount is also less uneven in the circumferential direction. Due to this, with a small amount of the adhesive 5A, it is possible to obtain sufficient adhesive strength between the cone 3 and the voice coil bobbin 61, and as a result, the sound quality stability is improved and it is possible to obtain good acoustic characteristics. For such an effect, there are few individual differences at the time of manufacturing a plurality of the speakers 1.

As described above, in order to make the fibers have a random orientation in the constituent material of the cone 3, it is preferable to manufacture the cone 3 with a dry method, that is, by dry fiber technology as in the manufacturing method described below. That is, the fibers are preferably fibers based on a defibrated material defibrated by a dry method.

The constituent materials of the cone 3 may include components other than the fibers and the resin. Examples thereof include the following additives. Examples of additives include neutralizing agents, fixing agents, tackifiers, sizing agents, paper strengthening agents, antifoaming agents, water retention agents, water resistance agents, aggregation suppressing agents for suppressing the aggregation of fibers and aggregation of resins, colorants such as carbon black and white pigments, flame retardants, and the like.

The average thickness t of the cone 3 is not particularly limited, but is preferably 0.15 mm or more and 2.0 mm or less, and more preferably 0.2 mm or more and 1.7 mm or less. Due to this, it is possible to obtain the lightweight cone 3 with good responsiveness and having sufficient rigidity, which contributes to the improvement of the acoustic characteristics.

Here, the thickness of the cone 3 is not limited to a case where the thickness is uniform throughout the cone 3, and there may be portions having a different thickness or portions having a gradually changing thickness. For example, there may be portions in which the thickness gradually decreases or gradually increases from the inner peripheral portion to the outer peripheral portion of the cone 3, that is, from a portion closer to the central axis J to a portion farther from the central axis J.

As described above, the speaker 1 is provided with the speaker diaphragm 2 having the cone 3 formed of a material including fibers derived from a plant and a resin for binding the fibers together, and the voice coil bobbin 61 which is adhered to the inner peripheral portion of the speaker diaphragm 2, that is, the edge portion of the opening 31 by the adhesive 5A. Due to this, with a small amount of the adhesive 5A, the adhesion portion between the cone 3 and the voice coil bobbin 61 is uniformly adhered without unevenness and sufficient adhesion strength is obtained and, as a result, the sound quality stability is improved and it is possible to obtain good acoustic characteristics. For such an effect, there are few individual differences at the time of manufacturing a plurality of the speakers 1.

3. Speaker Manufacturing Apparatus and Manufacturing Method

Figure 30:
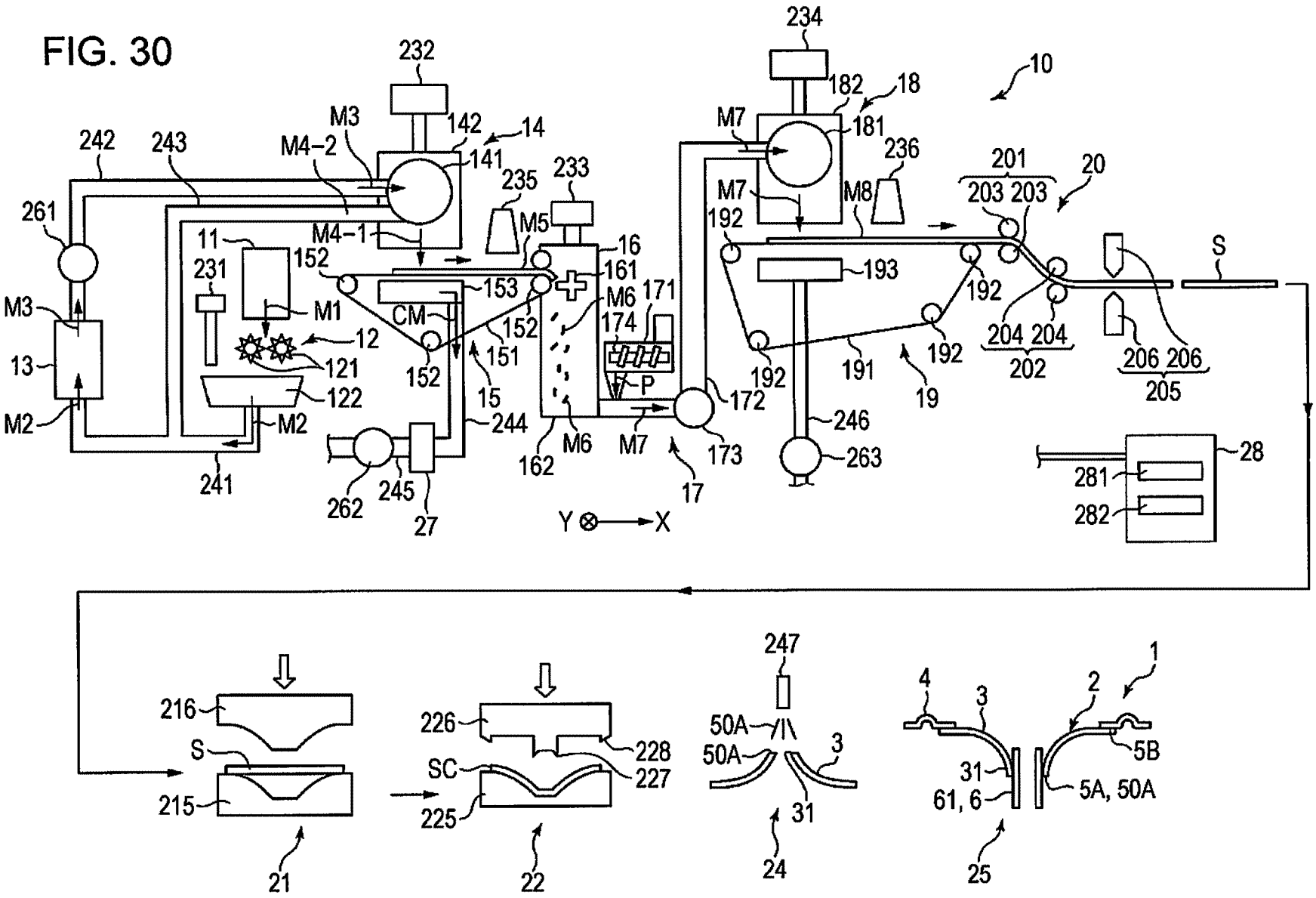
FIG. 30 is a view which shows an embodiment of a manufacturing apparatus and manufacturing steps for carrying out the method for manufacturing a speaker of the present disclosure.

FIG. 30 is a view which shows an embodiment of a manufacturing apparatus and manufacturing steps for carrying out the method for manufacturing a speaker of the present disclosure. A description will be given below of an embodiment of a method for manufacturing a speaker of the present disclosure with reference to FIG. 30.

In the following, for convenience of explanation, the upper side of FIG. 30 may be referred to as "top" or "upper" and the lower side as "bottom" or "lower", the upper left side may be referred to as "left" or "upstream", and the upper right side as "right" or "downstream".

As shown in FIG. 30, a speaker manufacturing apparatus 10 is an apparatus which executes a step of forming the cone 3 from a material including fibers defibrated by a dry method and a resin, and a step of manufacturing the speaker 1 using the cone 3, the apparatus being provided with a raw material supply portion 11, a crushing portion 12, a defibrating portion 13, a sorting portion 14, a first web forming portion 15, a division portion 16, a mixing portion 17, a loosening portion 18, a second web forming portion 19, a sheet forming portion 20, a first cone forming portion 21, a second cone forming portion 22, an adhesive application portion 24, and an assembly portion 25. In addition, the speaker manufacturing apparatus 10 is provided with a humidifying portion 231, a humidifying portion 232, a humidifying portion 233, a humidifying portion 234, a humidifying portion 235, a humidifying portion 236, a blower 261, a blower 262, and a blower 263.

In addition, each portion provided in the speaker manufacturing apparatus 10, for example, the raw material supply portion 11, the crushing portion 12, the defibrating portion 13, the sorting portion 14, the first web forming portion 15, the division portion 16, the mixing portion 17, the loosening portion 18, the second web forming portion 19, the sheet forming portion 20, the first cone forming portion 21, the second cone forming portion 22, the adhesive application portion 24, the assembly portion 25, and the like are electrically coupled to a control unit 28. The operation of each portion is controlled by the control unit 28. The control unit 28 has a central processing unit (CPU) 281 and a storage portion 282. It is possible for the CPU 281 to perform, for example, various determinations, various instructions, and the like. The storage portion 282 stores, for example, various programs such as programs up to the assembly of the speaker. In addition, the control unit 28 may be built in the speaker manufacturing apparatus 10 or may be provided in an external device such as an external computer. In addition, the external device may communicate with the speaker manufacturing apparatus 10 via a cable or the like, for example, may communicate wirelessly, may be connected to the speaker manufacturing apparatus 10 via a network such as the Internet, or the like. In addition, the CPU 281 and the storage portion 282 may be integrated, for example, and formed as one unit, the CPU 281 may be built in the speaker manufacturing apparatus 10 and the storage portion 282 may be provided in an external device such as an external computer, or the storage portion 282 may be built in the speaker manufacturing apparatus 10 and the CPU 281 may be provided in an external device such as an external computer.

In addition, in the speaker manufacturing apparatus 10, a raw material supply step, a crushing step, a defibrating step, a sorting step, a first web forming step, a dividing step, a mixing step, a loosening step, a second web forming step, a sheet pressure forming step, a cutting step, a first cone forming step, a second cone forming step, an adhesive application step, and an assembly step involving curing of the adhesive are performed in this order.

A description will be given below of the configuration of each portion.

The raw material supply portion 11 is a portion which performs the raw material supply step of supplying a raw material M1 (base material) to the crushing portion 12. This raw material M1 is a sheet-like material including the fibers derived from a plant, that is, the cellulose fibers described above. In addition, the form of the raw material M1, such as a woven fabric and a nonwoven fabric, is not limited. In addition, the raw material M1 may be, for example, recycled paper (recycled paper) manufactured by defibrating waste paper, or synthetic paper represented by Yupo Paper (registered trademark).

The crushing portion 12 is a portion which performs a crushing step of crushing the raw material M1 supplied from the raw material supply portion 11 in the atmosphere (in the air) or the like. The crushing portion 12 is usually formed of a shredder, and has a pair of crushing blades 121 and a chute (hopper) 122.

The pair of crushing blades 121 crush the raw material M1 therebetween by rotating in the opposite direction to each other, that is, it is possible to cut the raw material M1 into crushed fragments M2 (shredder pieces) which are strip-like pieces. The shape and size of the crushed fragments M2 are preferably suitable for the defibrating treatment in the defibrating portion 13, for example, the length of one side is preferably a small piece of 100 mm or less, and more preferably a small piece of 10 mm or more and 70 mm or less.

The chute 122 is arranged below the pair of crushing blades 121 and has, for example, a funnel shape. Due to this, it is possible for the chute 122 to receive the crushed fragments M2 crushed by the crushing blades 121 and dropped.

In addition, the humidifying portion 231 is arranged above the chute 122 to be adjacent to the pair of crushing blades 121. The humidifying portion 231 humidifies the crushed fragments M2 in the chute 122. The humidifying portion 231 has a filter (not shown) including moisture and is formed of a vaporization type or warm air vaporization type humidifier which supplies humidified air whose humidity is increased to the crushed fragments M2 by allowing air to pass through the filter. Supplying the humidified air to the crushed fragments M2 makes it possible to suppress the crushed fragments M2 from attaching to the chute 122 or the like due to static electricity.

The chute 122 is coupled to the defibrating portion 13 via a pipe 241 which forms a flow path. The crushed fragments M2 collected in the chute 122 pass through the pipe 241 and are transported to the defibrating portion 13.

The defibrating portion 13 is a portion which performs a defibrating step of defibrating the crushed fragments M2 in the air, that is, with a dry method. The defibrating treatment in the defibrating portion 13 makes it possible to generate a defibrated material M3 from the crushed fragments M2. Here, "defibrate" refers to loosening the crushed fragments M2 formed by binding a plurality of fibers, one fiber at a time. The loosened fibers become the defibrated material M3. The shape of the defibrated material M3 is linear or band-like.

For example, in the present embodiment, the defibrating portion 13 is formed of an impeller mill having a rotor rotating at high speed and a liner positioned on the outer periphery of the rotor. The crushed fragments M2 flowing into the defibrating portion 13 are defibrated by being sandwiched between the rotor and the liner.

In addition, it is possible for the defibrating portion 13 to generate an air flow from the crushing portion 12 to the sorting portion 14 by the rotation of the rotor. Due to this, it is possible to suction the crushed fragments M2 from the pipe 241 to the defibrating portion 13. In addition, after the defibrating treatment, it is possible to send the defibrated material M3 out to the sorting portion 14 through a pipe 242.

In the middle of the pipe 242, the blower 261 is installed. The blower 261 is an air flow generating apparatus which generates an air flow toward the sorting portion 14. Due to this, the transfer of the defibrated material M3 to the sorting portion 14 is promoted.

The sorting portion 14 is a portion which performs a sorting step of sorting the defibrated material M3 according to the size of the length of the fibers. In the sorting portion 14, the defibrated material M3 is sorted into a first sorted material M4-1 and a second sorted material M4-2 larger than the first sorted material M4-1. The fibers in the first sorted material M 4-1 have a size suitable for the subsequent manufacturing of the sheet S and also the manufacturing of the cone 3. The values thereof are as described above. On the other hand, the second sorted material M4-2 includes, for example, products having insufficient defibration and products in which the defibrated fibers are excessively aggregated together.

The sorting portion 14 has a drum portion 141 and a housing portion 142 for housing the drum portion 141.

The drum portion 141 is a sieve formed of a mesh body in a cylindrical shape and which rotates around the central axis thereof. The defibrated material M3 flows into the drum portion 141 from the pipe 242. Then, due to the rotation of the drum portion 141, the defibrated material M3 smaller than the holes of the mesh is sorted as the first sorted material M4-1, and the defibrated material M3 having a size which is the holes of the mesh or larger is sorted as the second sorted material M4-2. Then, the first sorted material M4-1 falls from the drum portion 141.

On the other hand, the second sorted material M4-2 is sent out to a pipe 243 coupled to the drum portion 141. The pipe 243 is coupled to the pipe 241 at the opposite side (downstream) to the drum portion 141. The second sorted material M4-2 which passed through the pipe 243 joins the crushed fragments M2 in the pipe 241 and flows into the defibrating portion 13 together with the crushed fragments M2. Due to this, the second sorted material M4-2 is returned to the defibrating portion 13 and subjected to a defibrating treatment with the crushed fragments M2.

Selecting the holes of the mesh of the drum portion 141 makes it possible to set the size of the fibers in the first sorted material M4-1 passing through the drum portion 141 within a predetermined range. In addition, selecting the holes of a mesh belt 151 described below makes it possible to set the size of the fibers in the first sorted material M4-1 passing through the mesh belt 151 within a predetermined range. Performing these selections makes it possible to set the size of the fibers in the constituent material of the cone 3, in particular, the average fiber length of the fibers to appropriate values as described above.

In addition, the first sorted material M4-1 which passed through the drum portion 141 is dropped while being dispersed in air and goes to the first web forming portion (separation portion) 15 positioned below the drum portion 141. The first web forming portion 15 is a portion which performs a first web forming step of forming a first web M5 from the first sorted material M4-1. The first web forming portion 15 has a mesh belt (separation belt) 151, three stretching rollers 152, and a suction portion (suction mechanism) 153.

The mesh belt 151 is an endless belt and the first sorted material M4-1 is deposited thereon. The mesh belt 151 is wound around the three stretching rollers 152. The stretching rollers 152 are coupled to a drive portion (not shown) having a driving source such as a motor, a transmission, and the like and is rotationally driven by the driving of the drive portion such that the first sorted material M4-1 on the mesh belt 151 is transported downstream.

The first sorted material M4-1 has a size equal to or larger than the holes of the mesh belt 151. Due to this, passage through the mesh belt 151 is restricted and it is possible to deposit the first sorted material M4-1 on the mesh belt 151. In addition, since the first sorted material M4-1 is transported downstream together with the mesh belt 151 while being deposited on the mesh belt 151, the first sorted material M4-1 forms the layered first web M5.

In addition, there is a concern that foreign matter CM, that is, for example, dust, dirt, and the like may be mixed in the first sorted material M4-1. Foreign matter CM may be generated, for example, by crushing or disintegration. Then, the foreign matter CM is recovered by a recovery portion 27 described below.

It is possible for the suction portion 153 to suction air from below the mesh belt 151. Due to this, it is possible to suction the foreign matter CM which passed through the mesh belt 151 together with air.

In addition, the suction portion 153 is coupled to the recovery portion 27 via a pipe 244. The foreign matter CM suctioned by the suction portion 153 is recovered by the recovery portion 27.

A pipe 245 is further coupled to the recovery portion 27. In addition, the blower 262 is installed in the middle of the pipe 245. The operation of the blower 262 makes it possible to generate a suction force in the suction portion 153. Due to this, the formation of the first web M5 on the mesh belt 151 is promoted. The foreign matter CM is removed from the first web M5. In addition, dust and dirt pass through the pipe 244 due to the operation of the blower 262 and reach the recovery portion 27.

The humidifying portion 232 is coupled to the housing portion 142. The humidifying portion 232 is formed of a vaporization type humidifier similar to the humidifying portion 231. Due to this, the humidified air is supplied into the housing portion 142. It is possible to humidify the first sorted material M4-1 with the humidified air and therefore, it is also possible to suppress the first sorted material M4-1 from attaching to the inner wall of the housing portion 142 by electrostatic force.

The humidifying portion 235 is arranged downstream of the sorting portion 14. The humidifying portion 235 is formed of an ultrasonic humidifier which sprays water. Due to this, it is possible to supply moisture to the first web M5 so as to adjust the water content of the first web M5. This adjustment makes it possible to suppress the adsorption of the first web M5 to the mesh belt 151 by electrostatic force. Due to this, the first web M5 is easily peeled off from the mesh belt 151 at a position where the mesh belt 151 is folded back by the stretching roller 152.

The division portion 16 is arranged downstream of the humidifying portion 235. The division portion 16 is a portion which performs a dividing step of dividing the first web M5 peeled off from the mesh belt 151. The division portion 16 has a rotatably supported propeller 161 and a housing portion 162 for housing the propeller 161. Then, it is possible to divide the first web M5 using the rotating propeller 161. The divided first web M5 becomes divided bodies M6. In addition, the divided bodies M6 descend in the housing portion 162.

The humidifying portion 233 is coupled to the housing portion 162. The humidifying portion 233 is formed of a vaporization type humidifier similar to the humidifying portion 231. Due to this, humidified air is supplied into the housing portion 162. It is also possible to suppress the divided bodies M6 from attaching to the propeller 161 and the inner wall of the housing portion 162 due to the electrostatic force with the humidified air.

The mixing portion 17 is arranged downstream of the division portion 16. The mixing portion 17 is a portion which performs the mixing step of mixing the divided bodies M6 and the resin P. The mixing portion 17 has a resin supply portion 171, a pipe 172, and a blower 173.

The pipe 172 couples the division portion 16 and the loosening portion 18 and is a flow path through which a mixture M7 of the divided bodies M6 and the resin P passes.

The resin supply portion 171 is coupled in the middle of the pipe 172. The resin supply portion 171 has a screw feeder 174. Rotating and driving the screw feeder 174 makes it possible to supply the resin P to the pipe 172 as powder or particles. The resin P supplied to the pipe 172 is mixed with the divided bodies M6 to form the mixture M7. Here, the resin P is a binding resin which binds the fibers together in a subsequent step, and the composition and the particle diameter thereof are as described above.

In addition to the resin P, the additives described above may be included as necessary by being supplied from the resin supply portion 171. The additives may be supplied separately from the resin P or may be supplied from the resin supply portion 171 as a (composite) mixture included in advance in the resin P.

In addition, the blower 173 is installed downstream of the resin supply portion 171 in the middle of the pipe 172. The divided bodies M6 and the resin P are mixed by the operation of a rotating portion such as the blades of the blower 173. In addition, it is possible for the blower 173 to generate an air flow toward the loosening portion 18 which performs the next step. This air flow makes it possible to stir and mix the divided bodies M6 and the resin P in the pipe 172. Due to this, it is possible for the mixture M7 to flow into the loosening portion 18 in a state in which the divided bodies M6 and the resin P are uniformly dispersed. In addition, the divided bodies M6 in the mixture M7 are loosened in the process of passing through the pipe 172 and become finer and more fibrous.

In addition, adjusting the supply amount of the resin P from the resin supply portion 171 with respect to the divided bodies M6 flowing from the division portion 16 into the pipe 172 makes it possible to set the blending ratio of the fibers and resin P in the mixture M7. It is possible to carry out this setting, for example, by adjusting the rotational speed of the screw feeder 174 under the control of the control unit 28 to adjust the amount of the resin P supplied per unit time. Performing such setting makes it possible to set the content of fibers or the content of resin in the constituent material of the cone 3 to the appropriate values as described above.

The loosening portion 18 is a portion which performs the loosening step of loosening the fibers intertwined with each other in the mixture M7. The loosening portion 18 has a drum portion 181 and a housing portion 182 for housing the drum portion 181.

The drum portion 181 is a sieve formed of a mesh body in a cylindrical shape and which rotates around the central axis thereof. The mixture M7 flows into the drum portion 181. Then, rotating the drum portion 181 makes it possible for fibers and the like, which are smaller than the holes, in the mixture M7 to pass through the drum portion 181. At that time, the mixture M7 is loosened.

The drum portion 181 is not limited to the shape of a rotating drum, and may be a sieve having holes which vibrate in the in-plane direction, or may be configured to eject the mixture M7 as a spray.

Then, the mixture M7 loosened by the drum portion 181 drops while being dispersed in air and travels to the second web forming portion 19 positioned below the drum portion 181. Accordingly, the fibers are randomly deposited in a state without orientation. The second web forming portion 19 is a portion which performs a second web forming step of forming a second web M8 from the mixture M7. The second web forming portion 19 has a mesh belt (separation belt) 191, a stretching roller 192, and a suction portion (suction mechanism) 193.

The mesh belt 191 is an endless belt and the mixture M7 is deposited thereon. The mesh belt 191 is wound around four stretching rollers 192. Then, the mixture M7 on the mesh belt 191 is transported downstream by the rotational drive of the stretching roller 192.

In addition, almost all of the mixture M7 on the mesh belt 191 has a size equal to or larger than the holes of the mesh belt 191. Due to this, passage of the mixture M7 through the mesh belt 191 is restricted such that it is possible to carry out deposition on the mesh belt 191. In addition, the mixture M7 is transported downstream together with the mesh belt 191 while being deposited on the mesh belt 191, and is thus formed as the layered second web M8.

The stretching rollers 192 are coupled to a drive portion (not shown) having a driving source such as a motor, a transmission, and the like and are able to rotate at a predetermined rotational speed by the operation of the drive portion. The operation of the drive portion is controlled by the control unit 28, for example, the rotation speed of the stretching roller 192 may be variable, and in particular, it is also possible to set the rotation speed with multiple steps or without steps.

The suction portion 193 is able to suction air from below the mesh belt 191. Due to this, it is possible to suction the mixture M7 on the mesh belt 191, that is, the second web M8 downward to make it possible to promote the deposition of the mixture M7 on the mesh belt 191 and promote the adjustment of the thickness of the second web M8 described below.

A pipe 246 is coupled to the suction portion 193. In addition, the blower 263 is installed in the middle of the pipe 246. The operation of the blower 263 makes it possible to generate a suction force at the suction portion 193. The operation of the blower 263 is controlled by the control unit 28.

A part of the mixture M7 which passed through the mesh belt 191 due to the air flow suctioned by the suction portion 193 is returned to the upstream path (not shown) by the air flow of the blower 263, for example, and reuse is possible by being supplied into the pipe 241 or into the housing portion 162.

As described above, the speaker manufacturing apparatus 10 has the suction portion 193 which suctions the second web M8 (the deposit) on the mesh belt 191 via the mesh belt 191. Due to this, it is possible to promote the deposition of the mixture M7 on the mesh belt 191, and to promote the adjustment of the thickness of the second web M8 described below. The random orientation of the fibers and the dispersibility of the mixture M7 are substantially maintained on the mesh belt 191.

Selecting the holes of the mesh belt 191, adjusting the suction strength of the suction portion 193, and the like make it possible to more finely adjust the size of the fibers in the mixture M7 passing through the mesh belt 191, in particular, the average fiber length of the fibers in an appropriate range. Due to this, it is possible to bring the size of the fibers in the constituent material of the cone 3, in particular, the average fiber length of the fibers, closer to the appropriate value as described above.

The humidifying portion 234 is coupled to the housing portion 182. The humidifying portion 234 is formed of a vaporization type humidifier similar to the humidifying portion 231. Due to this, humidified air is supplied into the housing portion 182. It is also possible to humidify the inside of the housing portion 182 with the humidified air so as to suppress the mixture M7 from attaching to the inner wall of the housing portion 182 due to the electrostatic force.

A humidifying portion 236 is arranged downstream of the loosening portion 18. The humidifying portion 236 is formed of an ultrasonic humidifier similar to the humidifying portion 235. Due to this, it is possible to supply the second web M8 with water so as to adjust the water content of the second web M8. This adjustment makes it possible to suppress the adsorption of the second web M8 to the mesh belt 191 by electrostatic force. Due to this, the second web M8 is easily peeled off from the mesh belt 191 at the position where the mesh belt 191 is folded back by the stretching roller 192.

Here, the water content (total water content) added to the humidifying portion 231 up to the humidifying portion 236 is preferably 0.5 parts by mass or more and 20 parts by mass or less with respect to 100 parts by mass of the materials before humidification, for example.

The sheet forming portion 20 is arranged downstream of the second web forming portion 19. The sheet forming portion 20 is a portion which performs a sheet forming step of forming the sheet S from the second web M8. The sheet forming portion 20 has a pressing portion 201 and a heating portion 202 which press and form the sheet S, and a cutting portion 205 which cuts the sheet S into a desired size.

The pressing portion 201 has a pair of calendar rollers 203 arranged above and below to sandwich the transport path of the second web M8, and presses the second web M8 between the calendar rollers 203. In such a case, the second web M8 is pressed without heating, that is, without melting the included resin P. Due to this, the second web M8 is pressed in the thickness direction to increase the density. Then, the second web M8 which passed through the pressing portion 201 is transported toward the heating portion 202. One of the pair of calendar rollers 203 is a main driving roller driven by the operation of a motor (not shown), and the other is a driven roller.

The heating portion 202 has a pair of heating rollers 204 respectively arranged above and below to sandwich the transport path of the second web M8, and presses the second web M8 between the heating rollers 204 while carrying out heating. This heating and pressing melts the resin P in the second web M8, and the fibers are bound together via the melted resin P. Due to this, the sheet S is formed. It is sufficient if the sheet S has a shape retaining property greater than that of the second web M8. Accordingly, other than in a case where the fibers P are completely melted to be bound together, the resin P in the second web M8 may be in a state in which all or part of the resin P is in a semi-molten state or a state in which the fibers are not completely bound. This state is referred to below as a "temporary binding state". Here, one of the pair of the heating rollers 204 is a main driving roller driven by the operation of a motor (not shown), and the other is a driven roller.

The sheet S obtained through the heating portion 202 is transported toward the cutting portion 205 arranged downstream.

The cutting portion 205 is a portion which performs a cutting step of cutting the sheet S into a predetermined length (size). The cutting portion 205 has a pair of cutting blades 206 arranged above and below to sandwich the sheet S transport path. Both cutting blades 206 operate to approach and separate each other in order to cut the sheet S in a direction crossing the transport direction, in particular, a direction orthogonal thereto. Both cutting blades 206 operate at a predetermined timing corresponding to the transport speed of the sheet S and cut the sheet S into a desired length. Although not shown, the width of the sheet S may be adjusted to a desired length by cutting the sheet S in a direction parallel to the transport direction. In such a case, one end portion and the other end portion in the width direction of the sheet S are cut and removed to adjust the sheet S to a desired width. As described above, the sheet S is formed by the sheet forming portion 20.

As shown in FIG. 30, the first cone forming portion 21, the second cone forming portion 22, the adhesive application portion 24, and the assembly portion 25 are arranged downstream of the cutting portion 205 in this order. Among the above, the first cone forming portion 21 and the second cone forming portion 22 are portions which perform a cone forming step of forming the cone 3 from the sheet S. Among these, the first cone forming portion 21 performs a first cone forming step, and the second cone forming portion 22 performs a second cone forming step.

The sheet S adjusted to a desired size by the cutting portion 205 is transported to the first cone forming portion 21. The first cone forming portion 21 has a first lower mold 215 and a first upper mold 216. The first lower mold 215 is formed with a concave-shaped cavity corresponding to the cone shape of the cone 3 to be manufactured, and the first upper mold 216 is formed with a convex shape corresponding to the cavity. The first lower mold 215 and the first upper mold 216 are formed of, for example, a metal material. In addition, the heater which is not illustrated is installed in at least one of the first lower mold 215 and the first upper mold 216, and carries out heating at the time of molding. In such a case, the heating temperature is a temperature which is the melting point or higher of the resin P included in the sheet S.

The sheet S is inserted between the first lower mold 215 and the first upper mold 216, and the sheet S is heated and pressed by the first lower mold 215 and the first upper mold 216 while being heated to a temperature which is the melting point or higher of the resin P and forms a cone shape without the opening 31. The deformed sheet SC which was formed is then released from the first lower mold 215 and the first upper mold 216, cooled, and transported to the second cone forming portion 22.

The pressure timing, pressure to be applied, heating temperature, and the like of the first lower mold 215 and the first upper mold 216 in the first cone forming portion 21 are controlled by the control unit 28.

The second cone forming portion 22 has a second lower mold 225 and a second upper mold 226. The second lower mold 225 is formed with a concave-shaped cavity corresponding to the cone shape of the cone 3 to be manufactured, and the second upper mold 226 is formed with a first punching blade 227 for forming the opening 31 in the central portion thereof, and a second punching blade 228 for adjusting the shape of the outer edge of the cone 3. The second lower mold 225 and the second upper mold 226 are formed of, for example, a metal material.

The deformed sheet SC is placed into the cavity of the second lower mold 225, and the second upper mold 226 is lowered to punch out and remove unnecessary portions of the deformed sheet SC. That is, the opening 31 is formed by the first punching blade 227, and the shape of the outer edge of the cone 3 is adjusted by the second punching blade 228. Due to this, the desired cone-shaped cone 3 is formed.

The opening 31 is formed by having the step of cutting out the inner peripheral portion of the speaker diaphragm 2 (deformed sheet SC) in parallel with the forming steps in this manner or after the step of forming the cone 3.

The control unit 28 controls the pressure timing, pressure to be applied, and the like of the second lower mold 225 and the second upper mold 226 in the second cone forming portion 22.

Although the second lower mold 225 was described as a dedicated mold used in the second cone forming portion 22, without being limited thereto, the first lower mold 215 of the first cone forming portion 21 may be transported to the second cone forming portion 22 and used as the second lower mold 225.

The above sheet forming portion 20, the first cone forming portion 21, and the second cone forming portion 22 form a cone manufacturing apparatus, in a narrow sense.

The cone 3 formed through the first cone forming portion 21 and the second cone forming portion 22 is transported to the adhesive application portion 24 in the next step. The adhesive application portion 24 is a portion which performs an adhesive application step of applying the adhesive 5A (liquid adhesive 50A) to the inner peripheral portion of the cone 3, that is, the edge portion of the opening 31.

The adhesive application portion 24 has a spray nozzle 247 which ejects the liquid adhesive 50A to be the adhesive 5A, and the liquid adhesive 50A is ejected from the spray nozzle 247 toward the edge portion of the opening 31 of the cone 3. Due to this, the liquid adhesive 50A attaches to the edge portion of the opening 31 of the cone 3. Here, examples of the liquid adhesive 50A include a solution obtained by diluting the uncured adhesive 5A with a solvent, a melted product of the adhesive 5A, or the like.

The ejection timing, ejection amount, temperature, and the like of the liquid adhesive 50A from the spray nozzle 247 in the adhesive application portion 24 are controlled by the control unit 28. As described above, in the present disclosure, it is possible to make the ejection amount of the liquid adhesive 50A, that is, the supply amount of the liquid adhesive 50A to the inner peripheral portion of the cone 3 smaller than in the related art.

The cone 3 to which the liquid adhesive 50A is applied is transported to the assembly portion 25 in the next step. The assembly portion 25 is a portion which performs an assembly step of curing (solidifying) the applied liquid adhesive 50A to adhere and fix the cone 3 to the voice coil bobbin 61 and of bonding the edge portion 4 to the outer peripheral portion of the cone 3.

The voice coil bobbin 61 forming the vibrator 6 is inserted into the opening 31 of the cone 3, positioning is carried out, and the liquid adhesive 50A is solidified, in particular, solidified, to form the adhesive 5A. In a case where the liquid adhesive 50A is a thermosetting type, for example, the liquid adhesive 50A is cured by heating using a method such as insertion into an oven or blowing hot air. In a case where the liquid adhesive 50A is a photo-curable type, in particular, an ultraviolet-curable type, the liquid adhesive 50A is cured by irradiation with ultraviolet light. In a case where the liquid adhesive 50A is a hot melt adhesive, the molten or softened liquid adhesive 50A is cooled and solidified. The cone 3 is adhered and fixed to the voice coil bobbin 61 by these methods.

In addition, the outer peripheral portion of the cone 3 and the inner peripheral portion of the edge 4 are adhered and fixed by the adhesive 5B. Due to this, the speaker diaphragm 2 is obtained. As the adhesive 5B, it is possible to use the same adhesive as the adhesive 5A. It is possible to carry out the adhesion between the cone 3 and the edge 4 in the same manner as described for the adhesion of the liquid adhesive 50A.

Either of the adhesion between the cone 3 and the voice coil bobbin 61 and the adhesion between the cone 3 and the edge 4 may be performed first, or both may be overlapped in terms of time.

In addition, although not shown in FIG. 30, the installation of the voice coil 62 on the voice coil bobbin 61, the installation of the permanent magnet 7, the yoke 71, the top plate 72, the damper 8, the ring member 81, and the like, the support for the frame 9 of each member, and the like are also performed as appropriate.

Through the above, the speaker 1 provided with the speaker diaphragm 2 is obtained.

Figure 31:
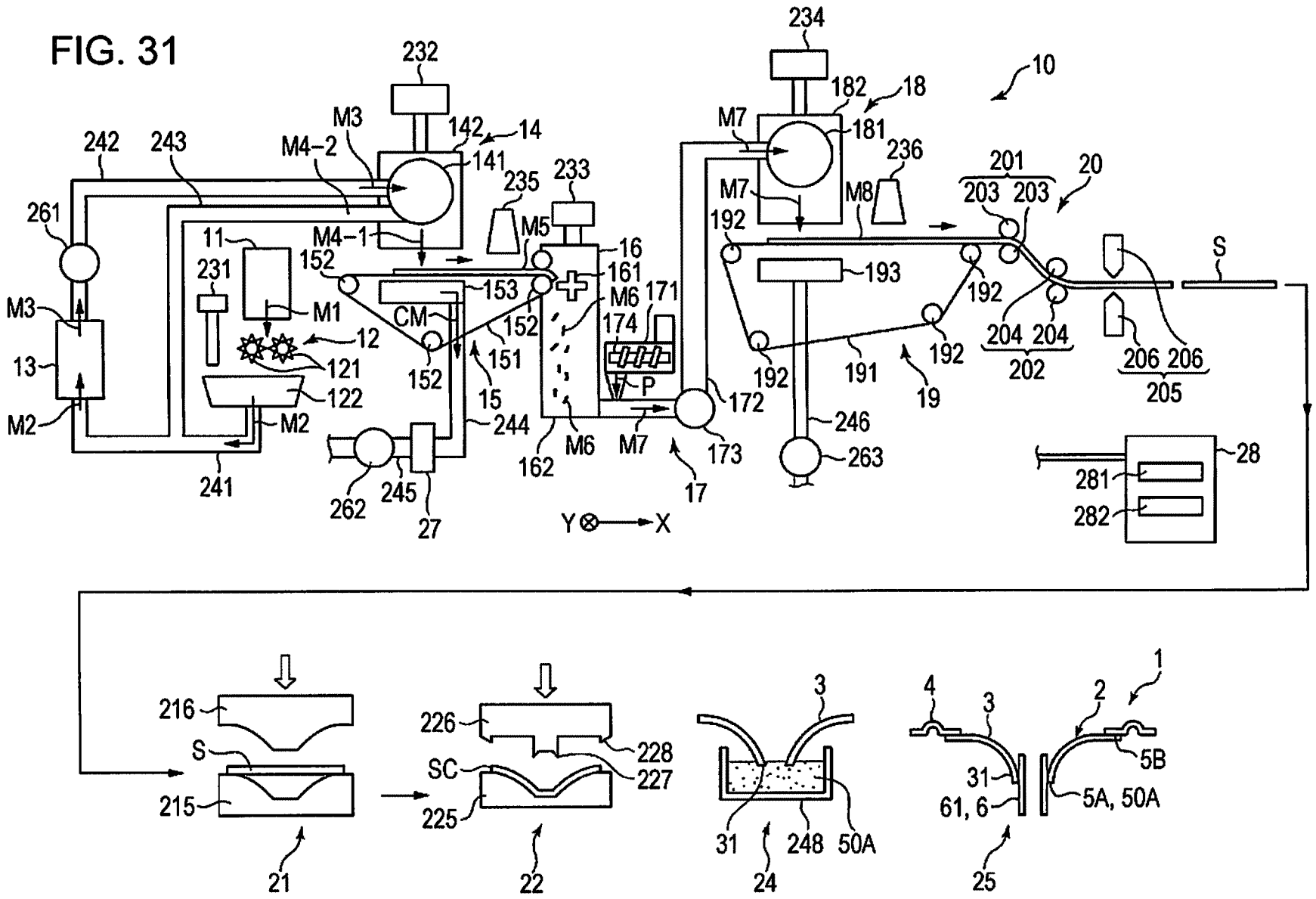
FIG. 31 is a view which shows another embodiment of a manufacturing apparatus and manufacturing steps for carrying out the method for manufacturing a speaker of the present disclosure.

FIG. 31 is a view which shows another embodiment of a manufacturing apparatus and manufacturing steps for carrying out the method for manufacturing a speaker of the present disclosure.

Although an embodiment of the method for manufacturing the speaker of the present disclosure shown in FIG. 31 will be described, the description of the same matters as the embodiment described above shown in FIG. 30 will be omitted, and the description will mainly focus on points of difference.

Below, for convenience of explanation, the upper side of FIG. 31 may be referred to as "top" or "upper" and the lower side as "bottom" or "lower", the upper left side may be referred to as "left" or "upstream", and the upper right side as "right" or "downstream".

As shown in FIG. 31, the speaker manufacturing apparatus 10 is provided with the raw material supply portion 11, the crushing portion 12, the defibrating portion 13, the sorting portion 14, the first web forming portion 15, the division portion 16, the mixing portion 17, the loosening portion 18, the second web forming portion 19, the sheet forming portion 20, the humidifying portion 231, the humidifying portion 232, the humidifying portion 233, the humidifying portion 234, the humidifying portion 235, the humidifying portion 236, the blower 261, the blower 262, the blower 263, the first cone forming portion 21, the second cone forming portion 22, the adhesive application portion 24, and the assembly portion 25; however, except for the difference in the configuration of the adhesive application portion 24, the speaker manufacturing apparatus 10 is the same as the speaker manufacturing apparatus 10 shown in FIG. 30.

The adhesive application portion 24 has a storage tank 248. In the storage tank 248, the liquid adhesive 50A which is cured (solidified) to become the adhesive 5A is stored. The edge portion of the opening 31 of the cone 3 obtained in the previous step is immersed, that is, dipped in the liquid adhesive 50A in the storage tank 248. Due to this, the liquid adhesive 50A attaches to the edge portion of the opening 31 of the cone 3.

As the liquid adhesive 50A, it is possible to use the same adhesives as described in the embodiment shown in FIG. 30. However, conditions such as the viscosity and temperature of the liquid adhesive 50A are adjusted to conditions suitable for dipping. This dipping may be performed a plurality of times.

The timing of the dipping of the liquid adhesive 50A, the liquid temperature, and the like in the adhesive application portion 24 are controlled by the control unit 28. In the same manner as described above, it is possible to make the attachment amount of the liquid adhesive 50A to the inner peripheral portion of the cone 3 smaller than in the related art.

The application of the liquid adhesive 50A in the adhesive application portion 24 is not limited to the spray ejection and dipping described above, but other methods may be used, for example, a method for applying the liquid adhesive 50A to the edge portion of the opening 31 by a dispenser, brush coating, or a method using a roll coater.

The cone 3 to which the liquid adhesive 50A is applied in the adhesive application portion 24 is transported to the assembly portion 25 in the next step, and is assembled into the speaker 1.

As described above, the method for manufacturing the speaker according to the present disclosure illustrated in FIG. 30 and FIG. 31 manufactures the speaker 1 having the speaker diaphragm 2 formed of material including fibers derived from a plant and a resin for binding the fibers together, the method including a step of forming the sheet S formed of the material described above; a step of forming the sheet S in a cone shape; a step of applying the adhesive, that is, the liquid adhesive 50A to the inner peripheral portion of the speaker diaphragm 2; and the step of curing (solidifying) the liquid adhesive 50A to form the adhesive 5A and adhering and fixing the speaker diaphragm 2 to the voice coil bobbin 61.

Due to this, it is possible to uniformly adhere the speaker diaphragm 2 and the voice coil bobbin 61 with a small amount of adhesive 5A without unevenness and with sufficient adhesive strength and, as a result, the sound quality stability is improved and it is possible to obtain a speaker having favorable acoustic characteristics. It is possible to obtain this excellent effect by a simple method by making the material used for molding the cone 3 into a material including fibers derived from a plant and a resin which binds the fibers together. In addition, in a case where a plurality of the speakers 1 are manufactured by the method for manufacturing the speaker of the present disclosure, there is also an advantage that there are few individual differences in the performance of each manufactured speaker.

Figure 32:
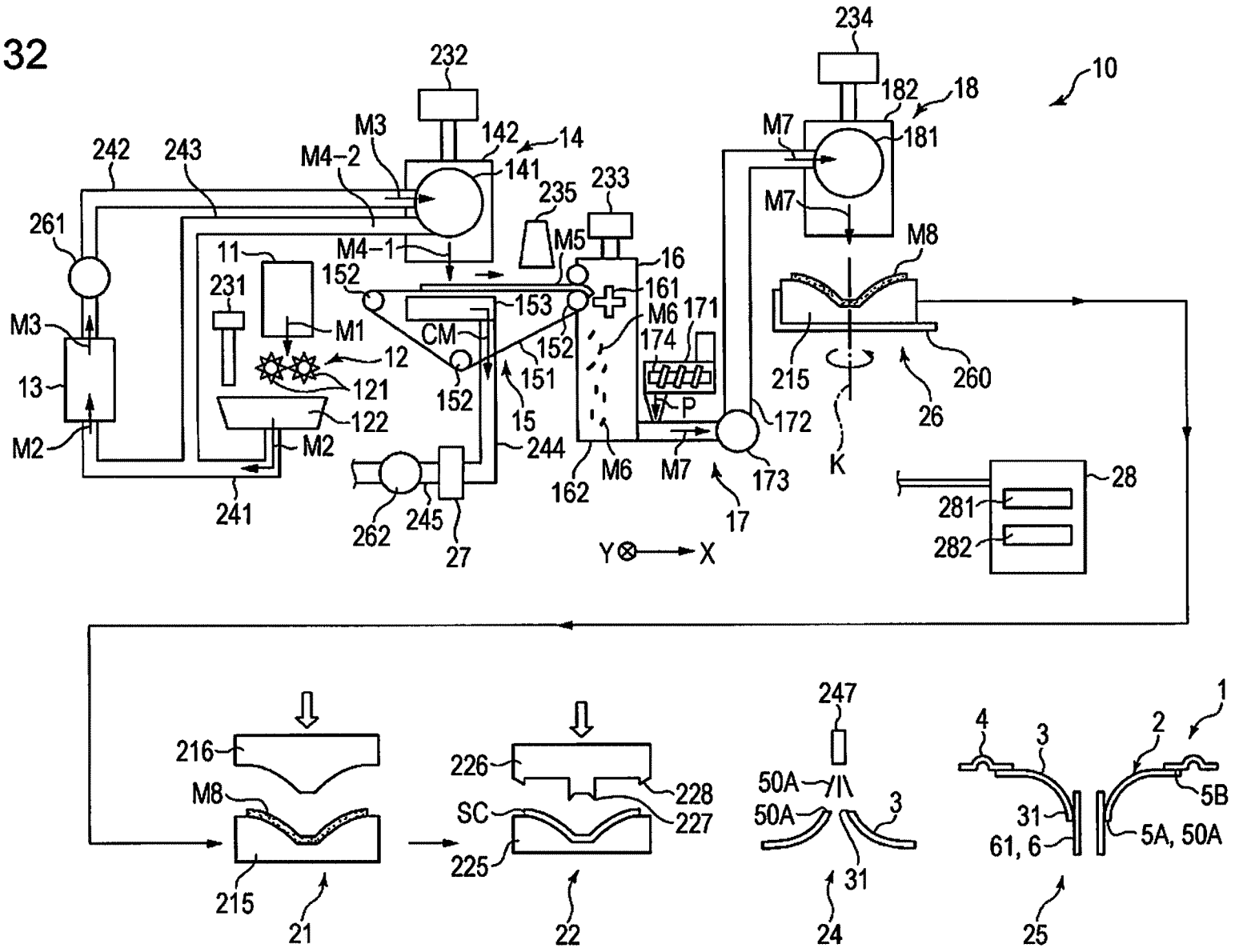
FIG. 32 is a view which shows another embodiment of a manufacturing apparatus and manufacturing steps for carrying out the method for manufacturing a speaker of the present disclosure.

FIG. 32 is a view which shows another embodiment of a manufacturing apparatus and manufacturing steps for carrying out the method for manufacturing a speaker of the present disclosure.

Although the embodiment of the method for manufacturing the speaker of the present disclosure shown in FIG. 32 will be described below, the description of the same matters as the embodiment described above shown in FIG. 30 will be omitted, and the description will mainly focus on points of difference.

In the following, for convenience of explanation, the upper side of FIG. 32 may be referred to as "top" or "upper" and the lower side as "bottom" or "lower", the upper left side may be referred to as "left" or "upstream", and the upper right side as "right" or "downstream".

As shown in FIG. 32, the speaker manufacturing apparatus 10 is provided with the raw material supply portion 11, the crushing portion 12, the defibrating portion 13, the sorting portion 14, the first web forming portion 15, the division portion 16, the mixing portion 17, the loosening portion 18, a web deposition portion 26, the humidifying portion 231, the humidifying portion 232, the humidifying portion 233, the humidifying portion 234, the humidifying portion 235, the blower 261, the blower 262, the first cone forming portion 21, the second cone forming portion 22, the adhesive application portion 24, and the assembly portion 25 and is the same as the speaker manufacturing apparatus 10 shown in FIG. 30 except that the second web forming portion 19 and the sheet forming portion 20 described above are not included. That is, the speaker manufacturing apparatus 10 shown in FIG. 30 forms the sheet S from the second web M8 and forms the sheet S into a cone shape to obtain the cone 3, while the speaker manufacturing apparatus 10 shown in FIG. 32 omits the formation of the sheet S and forms the cone 3 directly from the second web M8. A description will be given below of the details.

At the lower portion of the loosening portion 18, the web deposition portion 26 is arranged which deposits the mixture M7 dropped through the housing portion 182 to form a deposit of the second web M8.

The web deposition portion 26 has a mounting table 260 on which the first lower mold 215 is mounted. The first lower mold 215 is movable between the first cone forming portion 21 and the web deposition portion 26 and the first lower mold 215 is positioned at an appropriate position in the web deposition portion 26 by the mounting table 260. That is, the first lower mold 215 is positioned such that the central axis K of the concave cavity matches the center portion of the drop point where the mixture M7 falls.

The mixture M7 dropped from the loosening portion 18 is deposited in the cavity of the first lower mold 215 on the mounting table 260 and forms the second web M8 corresponding to a cone shape. In such a case, it is possible to deposit the second web M8 while rotating the mounting table 260 and the first lower mold 215 above around the central axis K. Due to this, it is possible to form the deposit of the second web M8 which does not have thickness unevenness in the peripheral direction.

In addition, it is also possible to perform operations such as, for example, applying lateral movement, vertical movement, inclination, rotation, vibration, and the like as appropriate with respect to the mounting table 260, and changing the thickness of the deposit of the second web M8 at the central portion and the outer peripheral portion of the cavity of the first lower mold 215. Due to this, for example, it is possible to easily form the cone 3 in which the thickness of the central portion is thicker than the peripheral portion, or conversely, the cone 3 in which the thickness of the peripheral portion is thicker than the central portion. In addition, it is possible to easily form the cone 3 in which the thickness of each of the portions of the cone 3 is equal and the density (rigidity) of the central portion is higher than that of the outer peripheral portion, or conversely, in which the density (rigidity) of the outer peripheral portion is higher than that of the central portion.

As described above, there is an advantage in that it is possible to easily manufacture the cones 3 having different conditions in each portion of the cones 3 such as thickness, density, rigidity, and flexibility in the cones 3 depending on, in particular, the distance from the central axis J.

When the desired amount of the second web M8 is deposited in the cavity of the first lower mold 215, the first lower mold 215 is transferred to the first cone forming portion 21.

In the first cone forming portion 21, the deposited second web M8 is heated and pressed by the transferred first lower mold 215 and first upper mold 216, and a cone-shaped deformed sheet SC having no opening 31 is formed. Thereafter, the sheet SC is released from the first lower mold 215 and the first upper mold 216, cooled, and transported to the second cone forming portion 22.

The transfer timing of the first lower mold 215 between the first cone forming portion 21 and the web deposition portion 26, the movement, inclination, rotation, vibration, and the like of the mounting table 260 in the lateral direction or vertical direction, and the pressure timing, pressure to be applied, heating temperature, and the like of the first lower mold 215 and the first upper mold 216 in the first cone forming portion 21 are controlled by the control unit 28.

The forming in the second cone forming portion 22 and the subsequent steps is the same as described above. In the embodiment shown in FIG. 32, it is possible to change the adhesive application portion 24 to the dipping method shown in FIG. 31, a method using a dispenser, brush coating, a method using a roll coater, or the like.

As described above, the method for manufacturing the speaker according to the present disclosure illustrated in FIG. 32 manufactures the speaker 1 which has the speaker diaphragm 2 formed of a material including fibers derived from a plant and a resin for binding the fibers together, the method including a step of depositing a web formed of the material described above, that is, the second web M8, in a cone shape; a step of heating and pressing a deposit of the second web M8, a step of applying an adhesive, that is, the liquid adhesive 50A, to the inner peripheral portion of the speaker diaphragm 2, and a step of curing (solidifying) the liquid adhesive 50A to form the adhesive 5A and of adhering and fixing the speaker diaphragm 2 to the voice coil bobbin 61.

Due to this, it is possible to uniformly adhere the cone 3 and the voice coil bobbin 61 with a small amount of adhesive 5A without unevenness and with sufficient adhesive strength and, as a result, the sound quality stability is improved and it is possible to obtain a speaker having favorable acoustic characteristics. It is possible to obtain this excellent effect by a simple method by making the material used for molding the cone 3 into a web including fibers derived from a plant and a resin which binds the fibers together.

In particular, since the formation of the sheet S as described above is omitted and the cone 3 is formed directly from the second web M8, the manufacturing is simplified further and the time taken for the manufacturing is also shortened.

In addition, it is possible to easily manufacture the speaker 1 provided with the cone 3 in which the thickness or density (stiffness) is different at each portion of the cone 3, in particular, corresponding to the distance from the central axis J. In addition, in a case where a plurality of the speakers 1 are manufactured by the method for manufacturing the speaker of the present disclosure, there is also an advantage that there are few individual differences in the performance of each manufactured speaker.

Ninth Embodiment

Figure 29:
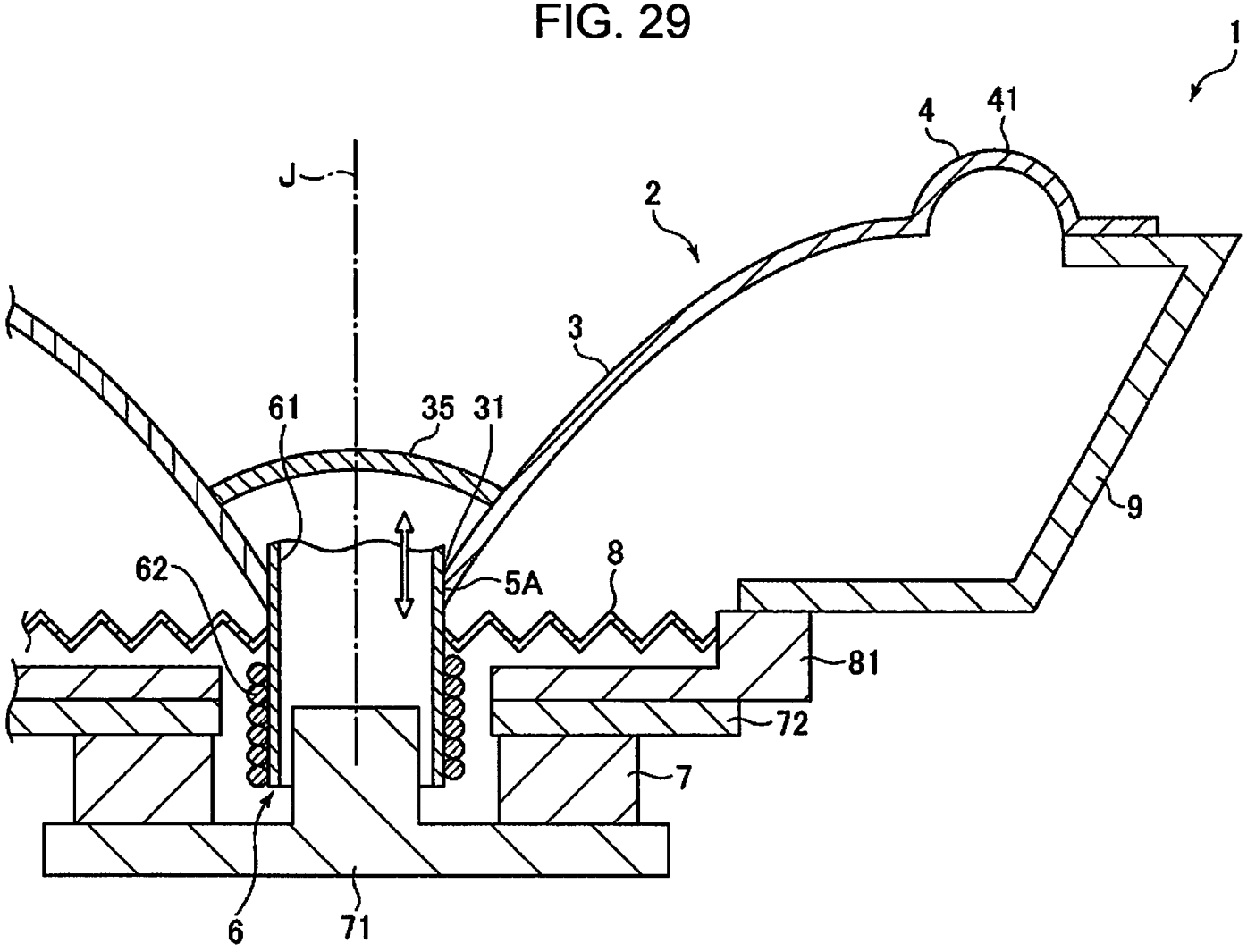
FIG. 29 is a longitudinal cross-sectional view which shows a ninth embodiment of a speaker of the present disclosure.

FIG. 29 is a longitudinal cross-sectional view which shows a ninth embodiment of a speaker of the present disclosure. Hereinafter, a description will be given of the ninth embodiment with reference to FIG. 29, but explanation will be given focusing mainly on differences from the eighth embodiment described above and explanation of the points of similarity will be omitted.

The speaker 1 of the present embodiment is the same as the eighth embodiment except that the configuration of the speaker diaphragm 2 is different. That is, as shown in FIG. 29, in the speaker diaphragm 2 in the present embodiment, the cone 3 and the edge portion 4 are integrally formed. Since there is no adhesion portion using the adhesive 5B as in the eighth embodiment, the sound quality stability is further improved, it is possible to obtain better acoustic characteristics, and it is also possible to simplify the manufacturing steps.

In addition, it is also possible to manufacture the speaker 1 of the present embodiment by the manufacturing apparatus and manufacturing method shown in FIGS. 30, 31, and 32. In these cases, the shape of the cavity of the first lower mold 215 may be such that the cone 3 and the edge 4 are continuous.

Although the speaker and the method for manufacturing the speaker of the present disclosure were explained above based on each illustrated embodiment, the present disclosure is not limited thereto and it is possible to replace each portion which forms the speaker diaphragm and the speaker with any configuration capable of exhibiting the same function. In addition, any component may be added thereto. In addition, also regarding the method for manufacturing a speaker, any configuration may be added before and after each step.

In addition, the speaker manufacturing apparatus may be a combination of any two or more configurations (features) of each of the embodiments above.

What is claimed is:

1. A speaker diaphragm comprising:

a cone formed of a first nonwoven material including first fibers derived from a plant and a first resin for binding the first fibers together; and an edge portion positioned on an outer peripheral portion of the cone and formed of a second material including a second resin, wherein the cone and the edge portion are integrally formed.

2. The speaker diaphragm according to claim 1, wherein the edge portion has a lower rigidity than the cone.

3. The speaker diaphragm according to claim 1, wherein the second material includes second fibers, and the first fibers and the second fibers are in a different condition.

4. The speaker diaphragm according to claim 3, wherein the condition is at least one of content, composition, an average fiber length, and an average fiber width.

5. The speaker diaphragm according to claim 1, wherein the first resin and the second resin are in a different condition.

6. The speaker diaphragm according to claim 5, wherein the condition is at least one of content and composition.

7. The speaker diaphragm according to claim 1, wherein a bulk density of the second material is lower than a bulk density of the first nonwoven material.

8. The speaker diaphragm according to claim 1, wherein at least one of the cone and the edge portion is formed of a laminate in which a plurality of laminated layers are laminated, and a number of laminated layers is different between the cone and the edge portion.

9. A speaker diaphragm comprising:

a cone which has a main body formed of a first material including first fibers derived from a plant and a first resin for binding the first fibers together, and an edge portion bonding site, which is positioned on an outer peripheral portion of the main body, which is formed of a second material including a second resin, and to which an edge portion is bonded, wherein a content ratio of the second resin in the second material is larger than a content ratio of the first resin in the first material.

10. The speaker diaphragm according to claim 9, further comprising:

the edge portion bonded to the edge portion bonding site.

11. A speaker unit comprising:

the speaker diaphragm according to claim 1; and a support portion which supports the edge portion of the speaker diaphragm.

12. A speaker comprising:

a speaker diaphragm formed of a material including fibers derived from a plant and a resin for binding the fibers together, the resin being added as a powder having an average particle diameter of 0.1 μm or more and 120 μm or less; and a voice coil bobbin adhered to an inner peripheral portion of the speaker diaphragm by an adhesive.

13. The speaker according to claim 12, wherein an average fiber length of the fibers is 0.05 mm or more and 3.0 mm or less.

14. The speaker according to claim 12, wherein an average fiber width of the fibers is 5 μm or more and 50 μm or less.

15. The speaker according to claim 12, wherein a content of the resin in the material is 15% by weight or more and 50% by weight or less.

16. The speaker according to claim 12, wherein an average thickness of the cone is 0.15 mm or more and 2.0 mm or less.

17. A method for manufacturing a speaker having a speaker diaphragm formed of a material including fibers derived from a plant and a resin which binds the fibers together, the method comprising:

adding the resin as a powder having an average particle diameter of 0.1 μm or more and 120 μm or less to obtain the material including the fibers and the resin;

forming a sheet formed of the material;

forming the sheet in a cone shape;

applying an adhesive to an inner peripheral portion of the speaker diaphragm; and adhering and fixing the speaker diaphragm to a voice coil bobbin by solidifying the adhesive.

18. A method for manufacturing a speaker having a speaker diaphragm formed of a material including fibers derived from a plant and a resin which binds the fibers together, the method comprising:

adding the resin as a powder having an average particle diameter of 0.1 μm or more and 120 μm or less to obtain the material including the fibers and the resin;

depositing a web including the fibers and the resin in a cone shape;

forming a deposit of the web by heating and pressing;

applying an adhesive to an inner peripheral portion of the speaker diaphragm; and adhering and fixing the speaker diaphragm to a voice coil bobbin by solidifying the adhesive.

19. The method for manufacturing a speaker according to claim 17, further comprising:

cutting out the inner peripheral portion of the speaker diaphragm in parallel with the forming or after the forming.

* * * * *